US011479426B2

(12) United States Patent
Ikeda et al.

(10) Patent No.: US 11,479,426 B2
(45) Date of Patent: Oct. 25, 2022

(54) SHEET FEEDING DEVICE AND IMAGE FORMING APPARATUS

(71) Applicant: FUJIFILM BUSINESS INNOVATION CORP., Tokyo (JP)

(72) Inventors: Masashi Ikeda, Kanagawa (JP); Shoichi Maeda, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 260 days.

(21) Appl. No.: 16/985,346

(22) Filed: Aug. 5, 2020

(65) Prior Publication Data

US 2021/0300700 A1 Sep. 30, 2021

(30) Foreign Application Priority Data

Mar. 24, 2020 (JP) ..... JP2020-053286

(51) Int. Cl.

| | |
|---|---|
| ***B65H 7/02*** | (2006.01) |
| ***B65H 7/20*** | (2006.01) |
| ***G03G 15/00*** | (2006.01) |
| ***B65H 1/04*** | (2006.01) |
| ***B65H 1/14*** | (2006.01) |
| ***B65H 7/04*** | (2006.01) |

(52) U.S. Cl.

CPC ..... *B65H 7/02* (2013.01); *B65H 1/04* (2013.01); *B65H 1/14* (2013.01); *B65H 7/04* (2013.01); *B65H 7/20* (2013.01); *G03G 15/6511* (2013.01); *G03G 15/6529* (2013.01); *B65H 2405/1122* (2013.01); *B65H 2511/11* (2013.01)

(58) Field of Classification Search

CPC ... B65H 1/00; B65H 1/04; B65H 1/14; B65H 1/26; B65H 7/02; B65H 7/04; B65H 7/14; B65H 7/20; B65H 2405/112; B65H 2405/1122; B65H 2511/11; G03G 15/6511

See application file for complete search history.

(56) References Cited

U.S. PATENT DOCUMENTS

| | | | | |
|---|---|---|---|---|
| 6,267,522 B1 * | 7/2001 | Slippy | ..... | B65H 1/04 101/232 |
| 2010/0090392 A1 * | 4/2010 | Ikeda | ..... | B65H 1/14 271/105 |

(Continued)

FOREIGN PATENT DOCUMENTS

JP 2016-000653 A 1/2016

*Primary Examiner* — Prasad V Gokhale
(74) *Attorney, Agent, or Firm* — Oliff PLC

(57) ABSTRACT

A sheet feeding device includes a sheet stacking unit, a long sheet stacking unit, a first guide, a first detector, and a closing unit. The sheet stacking unit is movable up and down. Sheets are stacked on the sheet stacking unit. The long sheet stacking unit is detachably mounted on the sheet stacking unit. Long sheets are stacked on the long sheet stacking unit. The first guide is movable along a feeding direction through a groove. The first guide is deformable into a shape that does not interfere with the long sheet stacking unit. The first guide guides a rear end portion of the sheets in the feeding direction. The first detector is provided in the first guide. The first detector detects the sheets stacked on the sheet stacking unit. The closing unit is detachably attached to the groove in the sheet stacking unit. The closing unit closes the groove.

18 Claims, 19 Drawing Sheets

(56) References Cited

U.S. PATENT DOCUMENTS

| | | | | |
|---|---|---|---|---|
| 2013/0106044 | A1* | 5/2013 | Inoue | B65H 3/0816 271/11 |
| 2016/0016740 | A1 | 1/2016 | Niikura et al. | |
| 2021/0061592 | A1* | 3/2021 | Ikeda | B65H 1/266 |

* cited by examiner

SHEET FEEDING DEVICE AND IMAGE FORMING APPARATUS

CROSS-REFERENCE TO RELATED APPLICATIONS

This application is based on and claims priority under 35 USC 119 from Japanese Patent Application No. 2020-053286 filed Mar. 24, 2020.

BACKGROUND

1. Technical Field

The present disclosure relates to a sheet feeding device and an image forming apparatus.

2. Related Art

In the related art, as a technique relating to a sheet feeding device, for example, as disclosed in JP-A-2016-000653, a configuration in which a long-sheet option is detachably provided in a sheet stacking unit when feeding long sheets has already been proposed.

SUMMARY

Aspects of non-limiting embodiments of the present disclosure relate to a sheet feeding device and an image forming apparatus capable of switching between feeding of long sheets and feeding of short sheets with a simple configuration, as compared with a case where a long-sheet option is detachably provided in a sheet stacking unit when feeding long sheets.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a sheet feeding device including a sheet stacking unit, a long sheet stacking unit, a first guide, a first detector, and a closing unit. The sheet stacking unit is movable up and down. The sheet stacking unit is configured such that sheets to be fed are stacked on the sheet stacking unit. The long sheet stacking unit is detachably mounted on the sheet stacking unit. The long sheet stacking unit is configured such that long sheets to be fed are stacked on the long sheet stacking unit. The first guide is movable along a feeding direction of the sheets through a groove provided in the sheet stacking unit. The first guide is deformable into a shape that does not interfere with the long sheet stacking unit. The first guide is configured to guide a rear end portion of the sheets in the feeding direction of the sheets stacked on the sheet stacking unit. The first detector is provided in the first guide. The first detector is configured to detect the sheets stacked on the sheet stacking unit by contacting an upper end of the sheets. The closing unit is detachably attached to the groove in the sheet stacking unit. The closing unit is configured to close the groove facing the first detector.

BRIEF DESCRIPTION OF THE DRAWINGS

Exemplary embodiment(s) of the present disclosure will be described in detail based on the following figures, wherein.

DETAILED DESCRIPTION

Hereinafter, exemplary embodiments of the present disclosure will be described with reference to the accompanying drawings.

First Exemplary Embodiment

Figure 1:
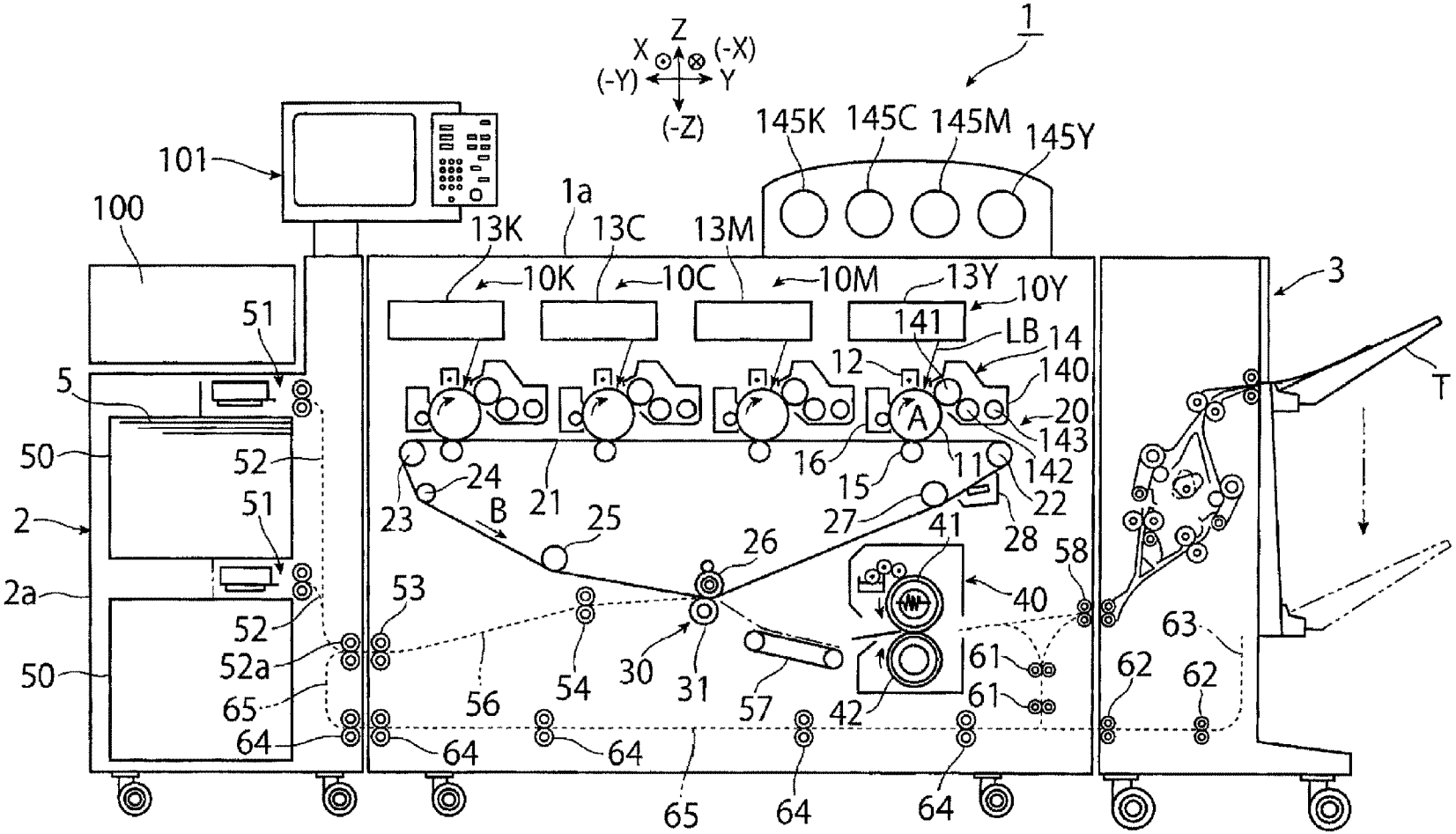
FIG. 1 is an overall configuration view illustrating an image forming apparatus to which a sheet feeding device according to a first exemplary embodiment of the present disclosure is applied.

FIG. 1 is a configuration view illustrating an overall outline of an image forming apparatus to which a sheet feeding device according to a first exemplary embodiment is applied. In the drawings, the front-rear direction is regarded as the X-axis direction, the left-right direction is regarded as the Y-axis direction, and the up-down direction is regarded as the Z-axis direction.

(Overall Configuration of Image Forming Apparatus)

An image forming apparatus 1 according to the first exemplary embodiment is configured as, for example, a color printer. The image forming apparatus 1 includes a sheet feeding device 2 disposed on one side (the left side in the illustrated example) of an apparatus body 1*a*, and a sheet discharge device 3 disposed on the other side (the right side in the illustrated example) of the apparatus body 1*a*. The sheet feeding device 2 is an example of a sheet feeding device. The apparatus body 1*a* of the image forming apparatus 1 includes a support structure member, an outer cover, and the like. Further, a broken line in the drawing indicates a main transport path along which a recording sheet 5 is transported inside the apparatus body 1*a* of the image forming apparatus 1, the sheet feeding device 2, or the sheet discharge device 3.

The image forming apparatus 1 includes plural image forming devices 10 configured to form a toner image developed with toner that constitutes a developer, an intermediate transfer device 20 configured to hold the toner images formed by the respective image forming devices 10 and finally transport to a secondary transfer portion that secondarily transfers to the recording sheet 5, the sheet feeding device 2 configured to accommodate and transport the required recording sheet 5 to be fed to the secondary transfer portion of the intermediate transfer device 20, a fixing device 40 configured to fix the toner images on the recording sheet 5 secondarily transferred in the intermediate transfer device 20, and the like. The recording sheet 5 is an example of a sheet.

The image forming device 10 includes four image forming devices 10Y, 10M, 10C, and 10K that exclusively form toner images of four colors of yellow (Y), magenta (M), cyan (C), and black (K), respectively. The four image forming devices 10 (Y, M, C, K) are arranged in one row along the horizontal direction in the inner space of the apparatus body 1*a*.

Each of the image forming devices 10 (Y, M, C, K) includes a rotating photoconductor drum 11 that is an example of an image carrier. Around the photoconductor drum 11, the following devices are mainly disposed as examples of a toner image forming unit. The main devices are a charging device 12 configured to charge a circumferential surface (an image carrying surface) of the photoconductor drum 11 on which an image may be formed to a required electric potential, an exposure device 13 configured to irradiate light based on image information (signal) on the charged circumferential surface of the photoconductor drum 11 to form an electrostatic latent image for each color having a potential difference, a developing device 14 (Y, M, C, K) that develops the electrostatic latent image into a toner image with a toner of a developer of corresponding colors (Y, M, C, K), a primary transfer device 15 (Y, M, C, K) that transfers each toner image to the intermediate transfer device 20, a drum cleaning device 16 (Y, M, C, K) that removes and cleans adhered substances such as toner remained and adhered on the image carrying surface of the photoconductor drum 11 after the primary transfer, and the like. The developing device 14 (Y, M, C, K) is an example of a developing unit. The primary transfer device 15 (Y, M, C, K) is an example of a primary transfer unit. The reference numeral indicating the member of the respective image forming devices 10 (Y, M, C, K) is attached only to the yellow image forming device 10Y, and is omitted in magenta (M), cyan (C), and black (K) image forming devices 10 (M, C, and K).

The photoconductor drum 11 is obtained by forming an image carrying surface having a light conductive layer (a photoconductive layer) made of a photoconductive material on a circumferential surface of a cylindrical or columnar substrate to be grounded. The photoconductor drum 11 is supported so as to be rotated in a direction indicated by the arrow A when power is transmitted from a driving device (not illustrated).

The charging device 12 includes a non-contact type charging device such as a scorotron disposed in a non-contact state on the surface of the photoconductor drum 11. A charging voltage is supplied to the charging device 12. As the charging voltage, when the developing device 14 performs reverse development, a voltage or current having the same polarity as the charging polarity of the toner supplied from the developing device 14 is supplied. A contact type charging roller or the like disposed in a contact state on the photoconductor drum 11 may be adopted as the charging device 12.

The exposure device 13 irradiates the circumferential surface of the photoconductor drum 11 after being charged with light (indicated by a solid line having an arrow) LB configured in accordance with image information input to the image forming apparatus 1 to form an electrostatic latent image. The exposure device 13 includes the exposure device 13 (Y, M, C, K) for the respective yellow (Y), magenta (M), cyan (C), and black (K) image forming devices. Image information (signal) corresponding to the full color or the monochrome input from a controller 100 to the image forming apparatus 1 in any manner when forming a latent image is sent to the exposure device 13. As the exposure device 13, an LED print head that irradiates the photoconductor drum 11 with light according to the image information by light emitting diodes (LED) as plural light emitting elements disposed along the axial direction of the photoconductor drum 11 of the respective image forming devices 10 to form an electrostatic latent image may be used.

Each of the developing devices 14 (Y, M, C, K) include a developing roller 141 retaining a developer and transporting the developer to a developing area facing the photoconductor drum 11, a supply transport member 142 such as a screw auger supplying the developer to the developing roller 141 while agitating the developer, an agitation transport member 143 such as a screw auger exchanging the developer with the supply transport member 142 and transporting while agitating the developer, a layer thickness regulating member (not illustrated) regulating an amount (the thickness of the layer) of the developer retained in the developing roller 141, and the like, in the inside of a device case 140 in which an opening and a developer accommodating chamber are formed. The developing roller 141 is an example of a developer carrier. As the respective four color developers (Y, M, C, K), for example, a two-component developer containing a non-magnetic toner and a magnetic carrier is used.

The primary transfer device 15 (Y, M, C, K) is a contact type transfer device having a primary transfer roller that is in contact with the periphery of the photoconductor drum 11 via an intermediate transfer belt 21 and rotates, and is supplied with a primary transfer voltage. A DC voltage having a polarity opposite to the charging polarity of the toner is supplied from a power supply device (not illustrated) as the primary transfer voltage.

The drum cleaning device 16 includes a body having a container shape with an opening, a cleaning plate that is in contact with the circumferential surface of the photoconductor drum 11 with a required pressure after the primary transfer and removes the adhered substances such as a residual toner to clean, a delivery member such as a screw auger transporting the adhered substances such as a toner removed by the cleaning plate and delivering to a collection system (not illustrated), and the like.

As illustrated in FIG. 1, the intermediate transfer device 20 is disposed so as to be located at a position below each image forming device 10 (Y, M, C, K). The intermediate transfer device 20 mainly includes the intermediate transfer belt 21 as an image carrier passing through a primary transfer portion between the photoconductor drum 11 and the primary transfer device 15 (the primary transfer roller) and rotating in a direction indicated by the arrow B, plural belt support rolls 22 to 27 holding the intermediate transfer belt 21 in a desired state from the inner surface thereof to rotatably support, a secondary transfer device 30 disposed on the outer circumferential surface (an image carrying surface) side of the intermediate transfer belt 21 supported by the belt support roller 26 and secondarily transferring the toner image on the intermediate transfer belt 21 to the recording sheet 5, and a belt cleaning device 28 removing and cleaning the adhered substances such as toner and paper dust remained and adhered on the outer circumferential surface of the intermediate transfer belt 21 after passing through the secondary transfer device 30. The secondary transfer device 30 is an example of a secondary transfer unit.

An endless belt made by a material in which, for example, a resistance adjusting agent such as a carbon black is dispersed in a synthetic resin such as polyimide resin or polyamide resin is used as the intermediate transfer belt 21. Further, the belt support roller 22 is configured as a driving roller rotatably driven by a driving device (not illustrated), the belt support roller 23 is configured as a surface forming roller forming an image formation surface of the intermediate transfer belt 21, the belt support roller 24 is configured as a tension applying roller applying tension to the intermediate transfer belt 21 and a meandering correcting roller correcting meandering of the intermediate transfer belt 21, and the belt support roller 25 is configured as a driven roller supporting the intermediate transfer belt 21, the belt support roller 26 is configured as a back support roller for the secondary transfer, and the belt support roller 27 is configured as an opposite roller of the belt cleaning device 28.

The secondary transfer device 30 is a contact type transfer device having a secondary transfer roller 31 rotating in contact with the circumferential surface of the intermediate transfer belt 21 in the secondary transfer portion that is the outer circumferential surface portion of the intermediate transfer belt 21 supported by the belt support roller 26 of the intermediate transfer device 20, and constituting the secondary transfer unit to which a secondary transfer voltage is supplied. The secondary transfer roller 31 is in contact with the belt support roller 26 whose position is fixed via the intermediate transfer belt 21 with a required pressing force. The secondary transfer device 30 includes the secondary transfer roller 31 and the belt support roller 26 supporting the back surface of the intermediate transfer belt 21. Further, a DC voltage having a polarity opposite to or the same as the charging polarity of the toner is supplied to the secondary transfer roller 31 or the belt support roller 26 as the secondary transfer voltage.

The belt cleaning device 28 is configured similarly to the drum cleaning device 16. The belt cleaning device 28 includes a body having a container shape with an opening, a cleaning plate (not illustrated) that is in contact with the circumferential surface of the intermediate transfer belt 21 with a required pressure after the primary transfer and removing the adhered substances such as a residual toner to clean, a delivery member such as a screw auger (not illustrated) transporting the adhered substances such as toner removed by the cleaning plate and delivering to a collection system, and the like.

The fixing device 40 includes a heating rotating body 41 having a roller form or a belt form that is heated by a heating unit such that the surface temperature is maintained at a required temperature, a pressurizing rotating body 42 having a roller form or a belt form that rotates in contact with a predetermined pressure in a state substantially along the axial direction of the heating rotating body 41, and the like. In the fixing device 40, a contact portion where the heating rotating body 41 and the pressurizing rotating body 42 are in contact with each other serves as a fixing processing unit that performs necessary fixing processings (heating and pressurizing).

The sheet feeding device 2 mainly includes a sheet feeding tray 50 configured to accommodate the recording sheets 5 of a desired size and type in a stacked state, a delivery device 51 configured to deliver the recording sheets 5 one by one from the sheet feeding tray 50, and a transport path 52 including a transport guide (not illustrated) having a transport roller 52*a* that transports the recording sheets 5 fed from the sheet feeding tray 50 into the apparatus body 1*a* of the image forming apparatus 1. The sheet feeding tray 50 is an example of plural (or a single) sheet accommodating containers. The sheet feeding tray 50 is attached such that the sheet feeding tray 50 can be pulled out, for example, to the front side (the side surface facing the user during operation) of the body 2*a* of the sheet feeding device 2. The sheet feeding device 2 will be described in detail later.

Examples of the recording sheet 5 may include a plain sheet used in, for example, an electrophotographic copying machine and printer, a thin sheet such as a tracing sheet, an OHP sheet, or the like. In order to further improve the smoothness of the image surface after fixing, the surface of the recording sheet 5 may be as smooth as possible, and for example, a so-called thick sheet having a relatively large basis weight such as a coated sheet obtained by coating the surface of a plain sheet with resin or the like, an art sheet for printing, or the like may be properly used.

In the apparatus body 1*a* of the image forming apparatus 1, a sheet feeding transport path 56 including plural (or a single) sheet transport roller pairs 53 and 54 transporting the recording sheet 5 delivered from the sheet feeding device 2 to the secondary transfer portion, a transport guide (not illustrated), and the like are provided between the sheet feeding device 2 and the secondary transfer device 30. The sheet transport roller pair 54 is configured as, for example, a roller that adjusts a transport timing of the recording sheet 5 to the secondary transfer portion (a registration roller). Further, a transport belt 57 configured to transport the recording sheet 5 after the secondary transfer delivered from the secondary transfer roller 31 of the secondary transfer device 30 to the fixing device 40 is provided between the secondary transfer device 30 and the fixing device 40. Further, a sheet discharge roller pair 58 configured to discharge the recording sheet 5 after fixing delivered from the fixing device 40 to the sheet discharge device 3 provided on the side surface of the apparatus body 1*a* is disposed in a portion near a discharge port of the recording sheet 5 formed in the apparatus body 1*a*.

A switching gate (not illustrated) switching the sheet transport path is provided between the fixing device 40 and the sheet discharge roller pair 58. When forming images on both surfaces of the recording sheet 5 or discharging the recording sheet 5 with reversed front and back sides, the transport direction of the recording sheet 5 having an image formed on one surface is switched downward by the switching gate, and the recording sheet 5 is once transported to a reversing path 63 having sheet transport roller pairs 61 and 62. Then, the recording sheet 5 is reversed at its front side and back side by reversing the transport direction from the reversing path 63 while the sheet transport roller pair 62 holds the end portion of the recording sheet 5, and transported to the normal sheet feeding transport path 56 through a double-sided transport path 65 including plural sheet transport roller pairs 64, a transport guide (not illustrated), and the like. Further, the recording sheet 5 whose front side and back side are reversed is discharged to the sheet discharge device 3 by the sheet transport roller pairs 61 and 62 and the sheet discharge roller pair 58. A part of the double-sided transport path 65 is provided through the inside of the sheet feeding device 2.

The sheet discharge device 3 is configured to correct the curl and the like of the recording sheets 5 on which an image is formed by the image forming apparatus 1 and sequentially discharge onto the sheet discharge tray T.

In FIG. 1, the reference numerals 145 (Y, M, C, K) respectively indicates toner cartridges disposed in plural along a direction orthogonal to the sheet surface and accommodating the developer containing at least toner supplied to the corresponding developing device 14 (Y, M, C, K).

Further, the reference numeral 100 in FIG. 1 indicates a controller disposed on the body 2*a* of the sheet feeding device 2 and configured to integrally control the operation of the image forming apparatus 1. The controller 100 includes a central processing unit (CPU), a read only memory (ROM), a random access memory (RAM) (not illustrated), or a bus connecting these CPU and ROM, a communication interface, and the like. The controller 100 performs an image processing necessary for an image signal input from the outside, and then, outputs an image signal corresponding to the exposure device 13 (Y, M, C, K) for the respective yellow (Y), magenta (M), cyan (C), and black (K) image forming devices.

Further, the reference numeral 101 indicates an operation display for a user to operate the image forming apparatus 1, respectively. The operation display 101 designates a size of the recording sheet 5 (including a long recording sheet), a type of the recording sheet 5 such as a plain sheet, a thin sheet, a thick sheet (including a rough sheet), and the like, the number of prints, and moreover, an image forming mode such as a full color mode or a monochrome mode. The controller 100 may be configured to automatically discriminate whether the size of the recording sheet 5 and whether the recording sheet 5 is a plain sheet, a thin sheet, a thick sheet, and the like, by a signal from an identification unit (not illustrated) provided in the sheet feeding tray 50.

(Operation of Image Forming Apparatus)

Hereinafter, descriptions will be made on a basic image forming operation by the image forming apparatus 1.

Here, an operation that forms a full color image that is a combination of toner images of four colors (Y, M, C, K) using the four image forming devices 10 (Y, M, C, K) will be described.

In the image forming apparatus 1, when the controller 100 receives command information of requirement for an image forming operation (print) designating the recording sheet 5 from the operation display 101, the four image forming devices 10 (Y, M, C, K), the intermediate transfer device 20, the secondary transfer device 30, the sheet feeding device 2, the fixing device 40, and the like are started.

Then, in each of the respective image forming devices 10 (Y, M, C, K), each photoconductor drum 11 first rotates in the direction indicated by the arrow A, and each charging device 12 charges the surface of each photoconductor drum 11 at a required polarity (negative in the first exemplary embodiment) and electric potential. Subsequently, the exposure devices 13 (Y, M, C, K) irradiates light LB emitted based on an image signal obtained by converting the image signal input to the image forming apparatus 1 into the respective color components (Y, M, C, K) to the surface of the photoconductor drum 11 after charging, then an electrostatic latent image of each color component formed by a required potential difference is formed on the surface, respectively.

Subsequently, each of the image forming devices 10 (Y, M, C, K) respectively supplies toner of the corresponding colors (Y, M, C, K) charged to the required polarity (negative polarity) from the developing roller 141 to be electrostatically adhered to perform development, with respect to the electrostatic latent image of each color component formed on the photoconductor drum 11. By this development, the electrostatic latent image of each color component formed on each photoconductor drum 11 is developed as toner images of the four colors (Y, M, C, K) respectively developed with toner of the corresponding color.

Subsequently, when the toner image of each color of the respective image forming devices 10 (Y, M, C, K) formed on the photoconductor drum 11 is transported to the primary transfer portion, the primary transfer device 15 primarily transfers the toner image of each color in a sequentially overlapped state with respect to the intermediate transfer belt 21 of the intermediate transfer device 20 rotating in the direction indicated by the arrow B.

Further, in each image forming device 10 in which the primary transfer is completed, the drum cleaning device 16 removes the adhered substances by scraping to clean the surface of the photoconductor drum 11. Therefore, each image forming device 10 becomes a state where the following image forming operation is possible.

Subsequently, the intermediate transfer device 20 holds the toner image primarily transferred and transports to the secondary transfer portion by the rotation of the intermediate transfer belt 21. Meanwhile, the sheet feeding device 2 delivers the required recording sheet 5 such as a plain sheet, a thick sheet, and the like designated by the operation display 101 in accordance with the image forming operation to the sheet feeding transport path 56. In the sheet feeding transport path 56, the sheet transport roller pair 54 serving as a registration roller delivers and feeds the recording sheet 5 to the secondary transfer portion in accordance with a transfer timing.

In the secondary transfer portion, the secondary transfer roller 31 of the secondary transfer device 30 is secondarily transfers the toner image on the intermediate transfer belt 21 to the recording sheet 5 collectively. Further, in the intermediate transfer device 20 in which the secondary transfer is completed, the belt cleaning device 28 removes the adhered substances such as toner remained on the surface of the intermediate transfer belt 21 after the secondary transfer to clean.

Subsequently, the recording sheet 5 to which the toner image is secondarily transferred is separated from the intermediate transfer belt 21 and the secondary transfer roller 31, and then transported to the fixing device 40 via the transport belt 57. In the fixing device 40, the recording sheet 5 after the secondary transfer is introduced into and passed through the contact portion between the heating rotating body 41 and the pressurizing rotating body 42 that are rotating, and thus, an unfixed toner image is fixed on the recording sheet 5 by performing the necessary fixing processings (heating and pressurizing). Finally, when the image forming operation in which an image is formed on one surface is performed, the recording sheet 5 after completing the fixing is discharged to the sheet discharge tray T of the sheet discharge device 3 installed on the side of the apparatus body 1*a* by the sheet discharge roller pair 58.

Further, when forming images on both surfaces of the recording sheet 5, the recording sheet 5 having an image formed on one surface is not discharged to the sheet discharge device 3 by the sheet discharge roller pair 58, and the transport direction of the recording sheet 5 is switched downward by the switching gate (not illustrated). The recording sheet 5 transported downward is reversed at its front side and back side by the reversing path 63 having the sheet transport roller pairs 61 and 62, and then, transported to the sheet feeding transport path 56 through the double-sided transport path 65. Then, the sheet transport roller pair 54 feeds the recording sheet 5 to the secondary transfer portion in accordance with the transfer timing, and an image is transferred and fixed on the back surface of the recording sheet 5, and then, discharged to the sheet discharge device 3 installed on the side of the apparatus body 1*a* by the sheet discharge roller pair 58.

By the above operation, the recording sheet 5 on which a full color image formed by combining toner images of four colors is output.

(Configuration of Sheet Feeding Device)

Figure 2:
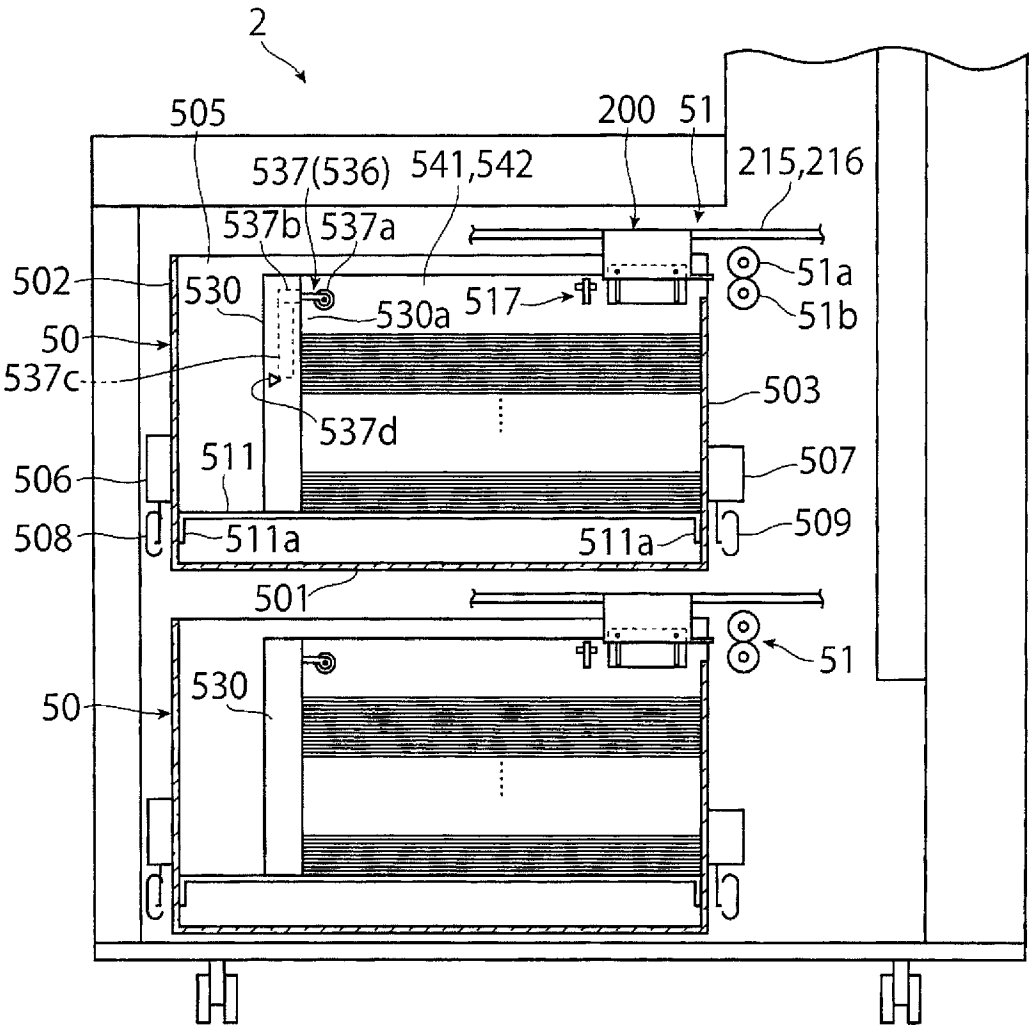
FIG. 2 is a cross-sectional configuration view illustrating a sheet feeding device as an example of the sheet feeding device according to the first exemplary embodiment of the present disclosure.
Figure 3:
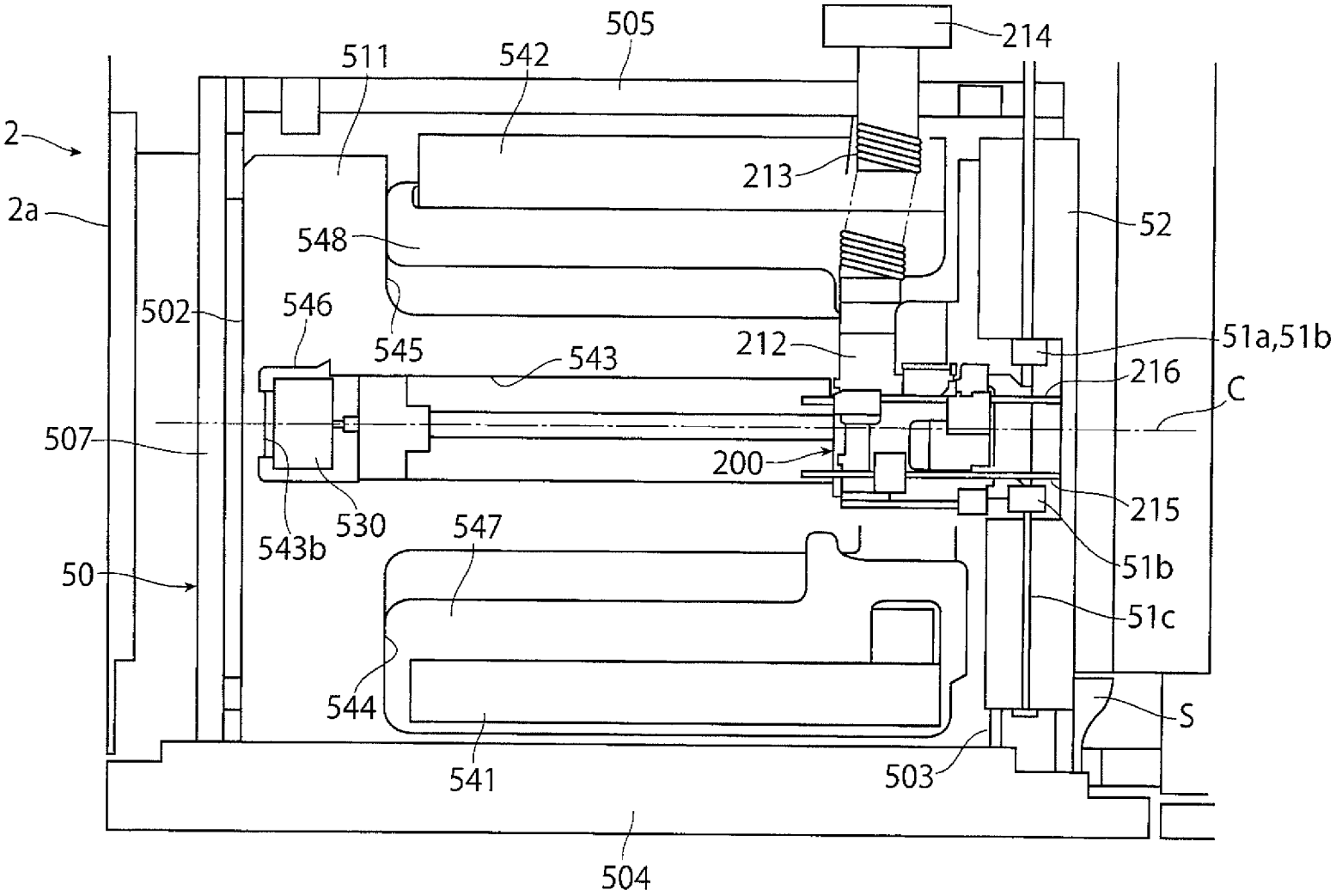
FIG. 3 is a planar configuration view illustrating the sheet feeding device as an example of the sheet feeding device according to the first exemplary embodiment of the present disclosure.
Figure 4:
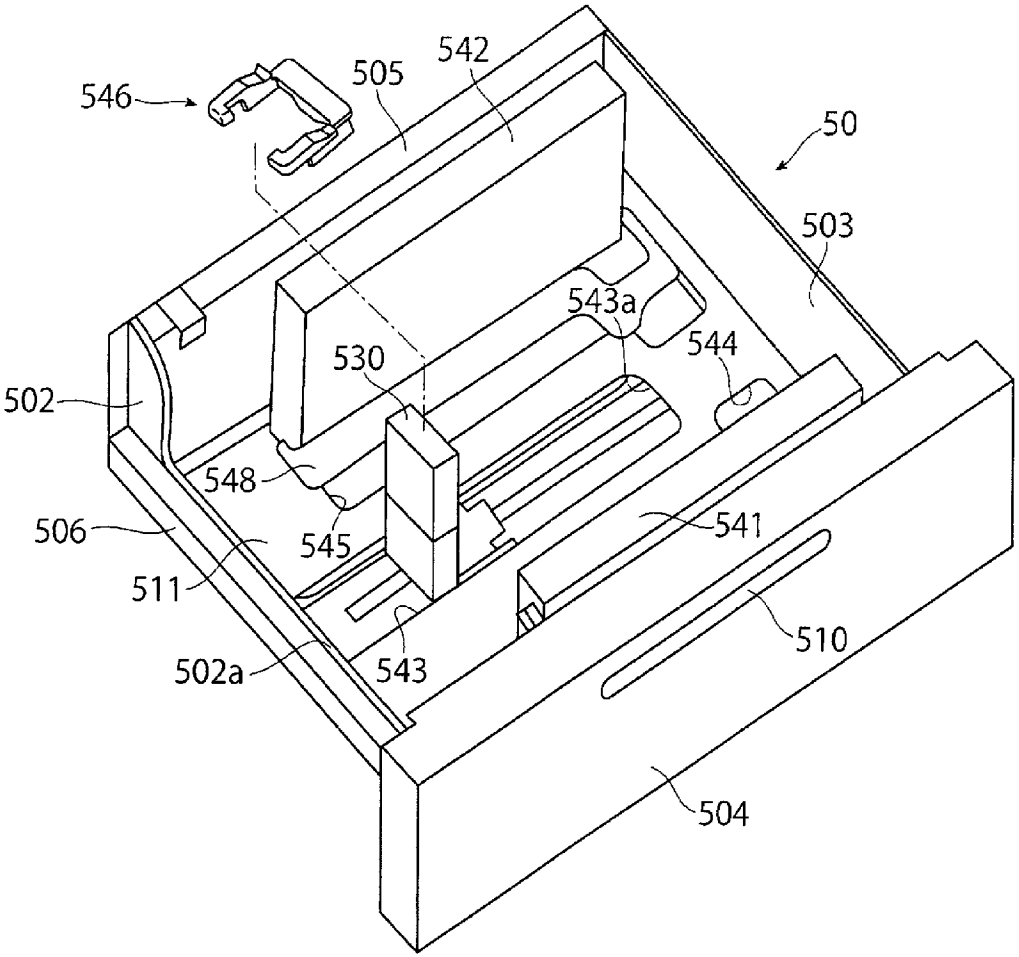
FIG. 4 is a perspective configuration view illustrating a sheet feeding tray.

FIG. 2 is a schematic configuration view illustrating the sheet feeding device as an example of the sheet feeding device according to the first exemplary embodiment, FIG. 3 is a planar configuration view illustrating a main part of the same sheet feeding device, and FIG. 4 is a perspective configuration view illustrating the sheet feeding tray.

As illustrated in FIG. 2, the sheet feeding device 2 includes plural or a single sheet feeding tray 50 that accommodates the recording sheet 5. The sheet feeding tray 50 is an example of a sheet accommodating container. As described above, the sheet feeding tray 50 is mounted so as to be pulled out to the front side with respect to the body 2*a* of the sheet feeding device 2.

As illustrated in FIGS. 2 to 4, the sheet feeding tray 50 is configured as a box body having a substantially rectangular parallelepiped shape whose upper end surface is entirely opened including a bottom wall 501 formed in a substantially rectangular shape in a plan view, left and right walls 502 and 503 provided at both sides of the bottom wall 501 in an upright state, respectively, a front wall 504 provided at a front side of the bottom wall 501 along the front-rear direction in an upright state, and a back wall 505 provided at a back side of the bottom wall 501 along the front-rear direction in an upright state.

The sheet feeding tray 50 as illustrated according to the first exemplary embodiment is configured as a large-capacity tray capable of accommodating a large number (for example, about 2,000 sheets) of recording sheets 5, and thus, the heights of the front wall 504, the back wall 505, and the like are set relatively high. However, the sheet feeding tray 50 is, of course, not limited to a large-capacity tray.

As will be described later, the sheet feeding tray 50 according to the first exemplary embodiment is configured to be detachably provided with a long sheet stacking device 6. As a result, as illustrated in FIG. 4, the left wall 502 of the sheet feeding tray 50 is configured such that the height of an intermediate portion 502*a* excluding both end portions in the front-rear direction is remarkably lower than that of the back wall 505. Reinforcing members 506 and 507 having a rotated U-shape cross section are provided along the front-rear direction on both outer side surfaces of the lower end portions of the right and left walls 502 and 503 of the sheet feeding tray 50. As illustrated in FIG. 2, guide rails 508 and 509 configured to mount the sheet feeding tray 50 to the body 2*a* so as to be pulled out are provided in the lower end portions of the reinforcing members 506 and 507 of the sheet feeding tray 50.

As illustrated in FIG. 4, the front wall 504 of the sheet feeding tray 50 is formed in a rectangular shape in a front view much larger than the front shape of the sheet feeding tray 50, and is formed to be relatively thick. The front wall 504 of the sheet feeding tray 50 also serves as a part of an outer cover disposed on the front surface of the body 2*a* of the sheet feeding device 2. A grip portion 510 on which the user holds his/her hands when pulling out the sheet feeding tray 50 is provided in the front wall 504 of the sheet feeding tray 50.

A bottom plate 511 having a flat plate shape is provided at the bottom portion in the sheet feeding tray 50. Sheets to be fed are stacked on the bottom plate 511. The bottom plate 511 is movable up and down. The bottom plate 511 is an example of a sheet stacking unit. The bottom plate 511 is formed in a substantially rectangular shape in a plan view much smaller than the bottom wall 501 of the sheet feeding tray 50. The bottom plate 511 has an outer peripheral edge 511*a* (see FIG. 2) bent downward by, for example, a bending processing using a sheet metal to enhance the rigidity thereof so that a large number of recording sheets 5 may be stacked. The bottom plate 511 is not necessarily a single member, and may be combining members formed by plural sheet metals or the like.

Figure 5:
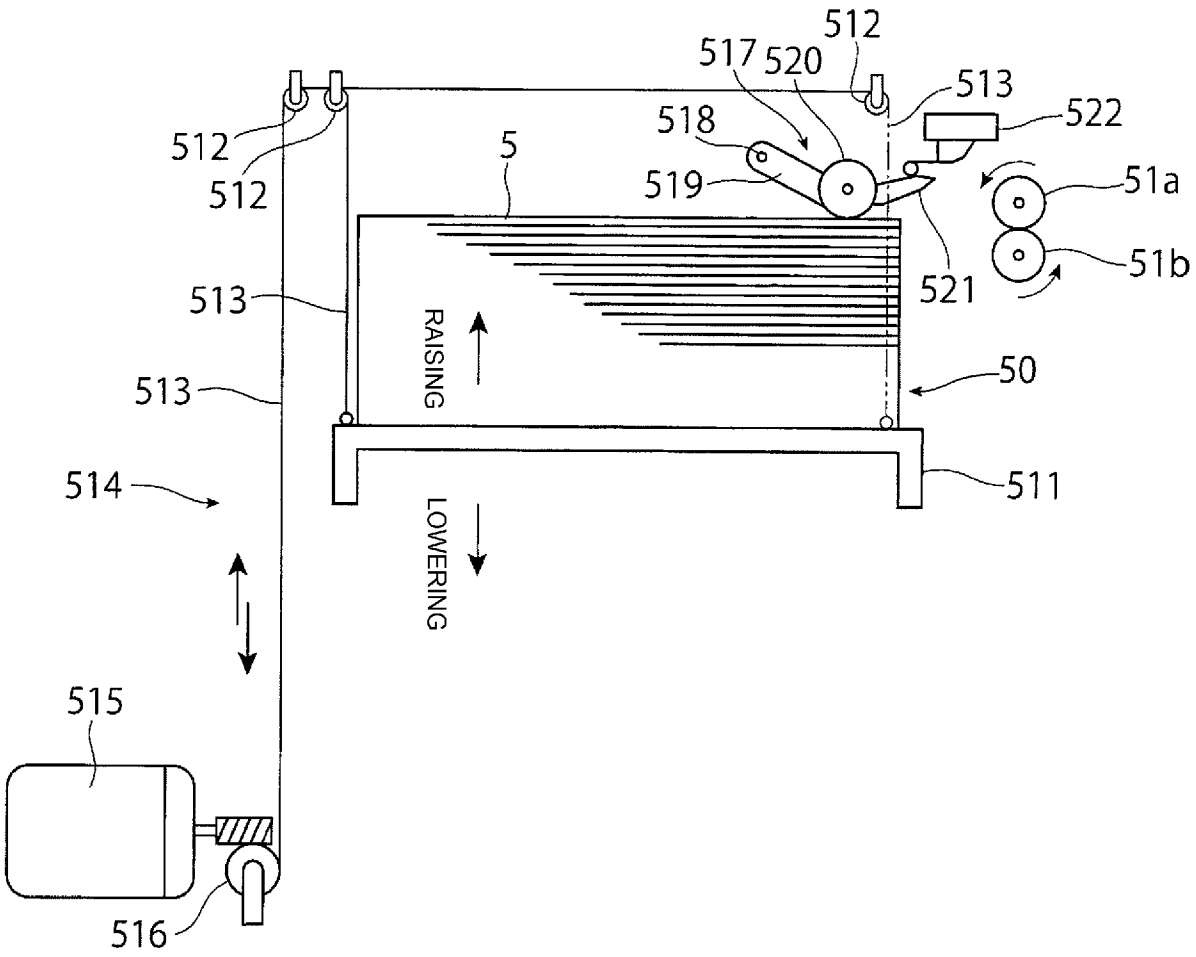
FIG. 5 is a schematic configuration view illustrating a mechanism configured to move a bottom plate up and down.

As illustrated in FIG. 5, the bottom plate 511 is configured to be movable up and down along the vertical direction by an elevating unit 514 including plural pulleys 512 provided in the body 2*a* of the sheet feeding device 2, the back wall 505, the front wall 504, and the like of the sheet feeding tray 50, plural driving wires 513, and the like while being horizontally maintained in a state where the recording sheets 5 are stacked. The driving wires 513 are configured to be windable and rewindable on a winding pulley 516 rotationally driven by a driving motor 515. In the illustrated example, for convenience, the driving motor 515 and the winding pulley 516 are illustrated at positions separated from the sheet feeding tray 50. However, the driving motor 515 and the winding pulley 516 are disposed below the right wall 503 of the sheet feeding tray 50.

The sheet feeding tray 50 includes a level sensor 517 at a position above the recording sheet 5 stacked on the bottom plate 511 and corresponding to the downstream end portion in the sheet feeding direction. The level sensor 517 detects the position of the upper end portion of the recording sheet 5 stacked on the bottom plate 511. The level sensor 517 is an example of an upper end detector. The level sensor 517 includes a detecting member 519 that is rotatable about a fulcrum 518. The detecting member 519 includes a rotatable roller 520 in contact with the surface of the uppermost recording sheet 5 stacked on the bottom plate 511, and a detecting portion 521 extending from the roller 520 to the side opposite to the fulcrum 518. A detecting element 522 including a micro switch or the like that is switched between ON and OFF by the detecting portion 521 is disposed on the side of the detecting portion 521 of the detecting member 519. An optical sensor that optically detects the position of the detecting portion 521 may be used as the detecting element 522 in place of a micro switch. In the level sensor 517, when the surface of the uppermost recording sheet 5 stacked on the bottom plate 511 reaches a predetermined height, the roller 520 of the detecting member 519 is brought into contact with the surface, and the detecting member 519 rotates along the counterclockwise direction in the drawing about the fulcrum 518. Then, in the level sensor 517, the detecting element 522 becomes an ON-state by the detecting portion 521 of the detecting member 519, and it is detected that the uppermost recording sheet 5 stacked on the bottom plate 511 reaches the predetermined height. In FIG. 5, for convenience, the members such as the detecting member 519 or the detecting element 522 are illustrated along the sheet feeding direction. However, as illustrated in FIG. 2, the members such as the detecting member 519 or the detecting element 522 are disposed along a direction intersecting the sheet feeding direction.

When the detecting element 522 becomes an ON-state, the controller 100 stops the driving motor 515 to stop the raising operation of the bottom plate 511.

Further, when the position of the uppermost recording sheet 5 stacked on the bottom plate 511 is lowered by feeding the recording sheets 5 from the sheet feeding device 2, the detecting member 519 rotates in the clockwise direction in the drawing about the fulcrum 518, and the detecting element 522 becomes an OFF-state by the detecting portion 521 of the detecting member 519.

When the detecting element 522 becomes an OFF-state, the controller 100 drives the driving motor 515 to start the raising operation of the bottom plate 511.

As a result, during the image forming operation, the uppermost recording sheet 5 stacked on the bottom plate 511 of the sheet feeding device 2 is controlled to always have a substantially constant height. The substantially constant height is a position where the uppermost recording sheet 5 may be fed from the sheet feeding tray 50.

As illustrated in FIG. 2, in the sheet feeding tray 50, the side wall 503 positioned on one side (right side in the example in the drawing) of the sheet feeding tray 50 in a state of being mounted to the body 2*a* of the sheet feeding device 2 becomes the front end portion (downstream end portion) in the sheet feeding direction in which the recording sheet 5 is fed. In the sheet feeding tray 50, when the recording sheets 5 are stacked on the bottom plate 511, the recording sheets 5 are accommodated in a state where the leading end portions of the recording sheets 5 in the sheet feeding direction abut against the right wall 503 of the sheet feeding tray 50.

As illustrated in FIG. 3, the image forming apparatus 1 to which the sheet feeding device 2 is mounted is configured to transport the recording sheet 5 with a center line C (a so-called center registration) in a direction intersecting the sheet feeding direction of the sheet feeding tray 50 as a reference, and form an image on the recording sheet 5. As a result, the sheet feeding tray 50 accommodates and feeds the recording sheet 5 at the center registration with the center line C in the direction intersecting the sheet feeding direction as a reference.

As illustrated in FIG. 2, in the base portion of the sheet feeding tray 50, a main end guide 530 that guides the rear end portion (upstream end portion) of the recording sheet 5 accommodated in the sheet feeding tray 50 in the sheet feeding direction, and two main side guides 541 and 542 that guide the both end portions of the recording sheet 5 accommodated in the sheet feeding tray 50 in the direction intersecting the sheet feeding direction are provided between the bottom plate 511 that is most lowered and the bottom wall 501. The main end guide 530 is an example of a first guide. The main side guides 541 and 542 are examples of a second guide. The main end guide 530 and the main side guides 541 and 542 guide the rear end portion of the recording sheet 5 in the sheet feeding direction and the both end portions of the recording sheet 5 in the direction intersecting the sheet feeding direction. The recording sheet 5 includes the recording sheet 5 of the maximum size that may be fed by the sheet feeding tray 50 alone.

The main end guide 530 is provided in the bottom wall 501 of the sheet feeding tray 50 so as to be movable along the sheet feeding direction of the recording sheet 5. The two main side guides 541 and 542 are provided in the bottom wall 501 of the sheet feeding tray 50 so as to be movable along the direction intersecting the sheet feeding direction of the recording sheet 5. As described above, since the sheet feeding tray 50 accommodates and feeds the recording sheets 5 at the center registration, the two main side guides 541 and 542 are movable by a rack gear, a pinion gear, and the like (not illustrated) to positions symmetrical with the center line C in the direction intersecting the sheet feeding direction of the recording sheet 5 as a reference.

As illustrated in FIG. 2, the main end guide 530 is, when the recording sheets 5 corresponding to the maximum load amount are stacked on the bottom plate 511, formed in a prismatic shape higher than the upper end surface of the recording sheets 5 corresponding to the maximum load amount. A downstream end surface 530*a* of the main end guide 530 in the sheet feeding direction is a plane that abuts against and guides (supports) the rear surface of the recording sheets 5 stacked on the bottom plate 511 in the sheet feeding direction.

Further, as will be described later, the main end guide 530 is provided, when mounting a long sheet stacking unit on the bottom plate 511, so as to be deformable into a shape that does not interfere with the long sheet stacking unit.

Figure 6:
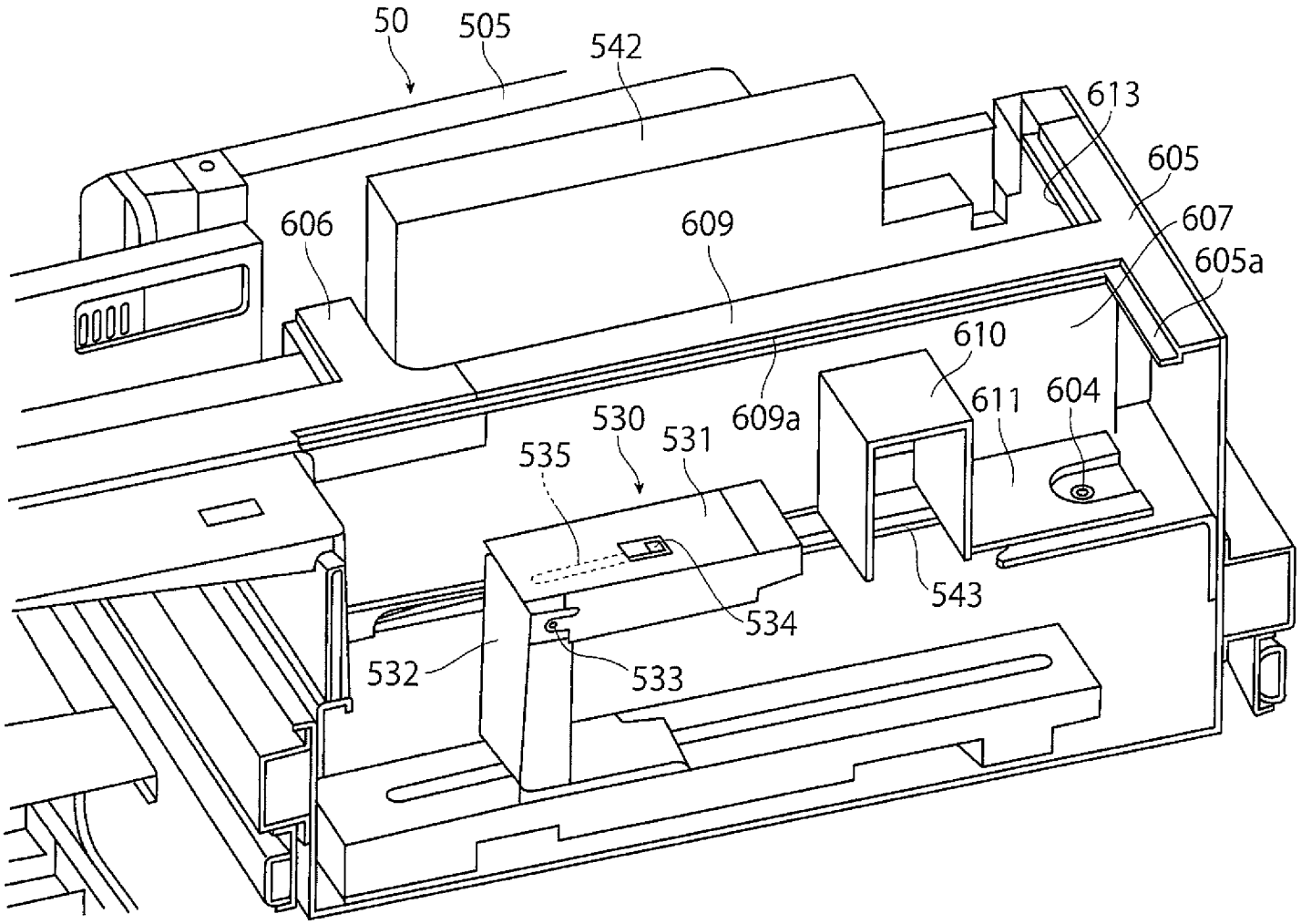
FIG. 6 is a partially cut perspective configuration view illustrating a main part of the sheet feeding device as an example of the sheet feeding device according to the first exemplary embodiment of the present disclosure.

As illustrated in FIG. 6, in the first exemplary embodiment, the main end guide 530 is configured to be foldable at an intermediate position in the vertical direction (the height direction). The main end guide 530 is divided into two members of an upper end portion 531 disposed on the upper side along the vertical direction, and a lower end portion 532 disposed on the lower side along the vertical direction. The upper end portion 531 and the lower end portion 532 of the main end guide 530 are connected by a hinge member 533 to be foldable toward the downstream in the sheet feeding direction. Inside the upper end portion 531 of the main end guide 530, a fixed shaft 535 movable along the vertical direction by sliding an operation portion 534 exposed on the side surface is provided. Further, inside the lower end portion 532 of the main end guide 530, a fixing hole (not illustrated) is provided such that a tip end portion of the fixed shaft 535 in the axial direction can be inserted into the fixing hole.

When guiding the rear end portion of the recording sheets 5 stacked on the bottom plate 511 in the sheet feeding direction, the main end guide 530 is rotated by approximately 90 degree about the hinge member 533 such that the upper end portion 531 is in an upright state linearly with respect to the lower end portion 532. Then, in the main end guide 530, the fixed shaft 535 provided in the upper end portion 531 is pushed downward by the operation portion 534, and then, the tip end of the fixed shaft 535 is inserted into the fixing hole (not illustrated) in the lower end portion 532 to fix the upper end portion 531 to the lower end portion 532.

Meanwhile, as will be described later, in the main end guide 530, in order not to interfere with a long sheet stacking unit when mounting the long sheet stacking unit on the bottom plate 511, the fixed shaft 535 provided in the upper end portion of the main end guide 530 is pushed upward by the operation portion 534 so that the tip end of the fixed shaft 535 is pulled out from the fixing hole (not illustrated) in the lower end portion 532 to release the connection between the upper end portion 531 and the lower end portion 532. Therefore, it is possible to fold the upper end portion 531 by approximately 90 degree about the hinge member 533 with respect to the lower end portion 532.

The main end guide 530 may only need to be deformable into a shape that does not interfere with the long sheet stacking unit. In addition to the configuration in which the upper end portion 531 is foldable with respect to the lower end portion 532, the main end guide 530 may be configured such that the upper end portion 531 is detachable with respect to the lower end portion 532 to detach the upper end portion 531, or the upper end portion 531 is slidable (sliding) with respect to the lower end portion 532 along the vertical direction, so as to be deformable into a shape that does not interfere with the long sheet stacking unit mounted on the bottom plate 511.

As illustrated in FIG. 2, the two main side guides 541 and 542 are disposed on both sides of the sheet feeding tray 50 in the front-rear direction intersecting the sheet feeding direction, respectively. The two main side guides 541 and 542 are formed in a rectangular parallelepiped shape having a height higher than the upper end surface of the recording sheets 5 when the recording sheets 5 corresponding to the maximum load amount are stacked on the bottom plate 511, and a required length in the sheet feeding direction.

As illustrated in FIGS. 3 and 4, in the bottom plate 511, plural notch portions 543, 544, and 545 configured to avoid interference with the main end guide 530 and the two main side guides 541 and 542, and allow movement of the main end guide 530 and the two main side guides 541 and 542 are provided. The first notch portion 543 allowing the movement of the main end guide 530 is formed in a recessed groove having an elongated rectangular shape in a plan view in the center portion of the bottom plate 511 in the direction intersecting the sheet feeding direction. The recessed groove has a required length in the sheet feeding direction and a required width. The first notch portion 543 allowing the movement of the main end guide 530 is formed from a position where a downstream end portion 543*a* in the sheet feeding direction of the bottom plate 511 is spaced apart from the right wall 503 of the sheet feeding tray 50 to the upstream by a required distance to the vicinity of the left wall 502 of the sheet feeding tray 50. Further, on both sides in the direction intersecting the sheet feeding direction of the bottom plate 511, the second notch portions 544 and 545 allowing the movement of the two main side guides 541 and 542 are formed in a substantially rectangular shape having substantially the same length as the main side guides 541 and 542 and a required width in the direction intersecting the sheet feeding direction of the bottom plate 511.

In the bottom plate 511, shutter members 546, 547, and 548 partially or entirely closing the first notch portion 543 and the second notch portions 544 and 545 to prevent the recording sheets 5 stacked on the bottom plate 511 from falling into the first notch portion 543 and the second notch portions 544 and 545. The shutter members 547 and 548 closing the second notch portions 544 and 545 in the bottom plate 511 includes a substantially rectangular thin plate member that is divided into plural pieces or is a single piece along the direction intersecting the sheet feeding direction, and move together with the main side guides 541 and 542 to close the second notch portions 544 and 545.

The shutter member 546 closing the first notch portion 543 in the bottom plate 511 will be described later.

Meanwhile, when feeding the recording sheet 5 from the sheet feeding tray 50, the sheet feeding device 2 in the related art includes a nudger roller in contact with the surface of the uppermost recording sheet 5 among the recording sheets 5 stacked in the sheet feeding tray 50. Then, the sheet feeding device 2 in the related art is configured to pick up and transport the uppermost recording sheet 5 to the downstream by the nudger roller, and separate and feed the recording sheets 5 one by one by a pickup roller and a retard roller that is in contact with each other downstream of the nudger roller.

However, in the sheet feeding device 2 in the related art, since the recording sheets 5 stacked in the sheet feeding tray 50 are picked up and fed to the downstream by the nudger roller including a rubber roller or the like, due to the influence of paper dust and the like attached to the surface of the recording sheet 5, the frictional force acting between the nudger roller and the recording sheet 5 is reduced which may cause misfeed that is a sheet feeding failure.

Therefore, as illustrated in FIGS. 2 and 3, the sheet feeding device 2 according to the first exemplary embodiment include a suction head member 200 configured to lift a part of the recording sheet 5 by suctioning up a part of the fed recording sheet 5 and move the leading end of the lifted recording sheet 5 to the downstream in the sheet feeding direction of the recording sheet 5. The suction head member 200 is an example of a suction unit. A pickup roller 51*a* and a retard roller 51*b* that constitute the delivery device 51 together with the suction head member 200 are disposed downstream of the suction head member 200 in the sheet feeding direction in the sheet feeding tray 50. The pickup roller 51*a* is configured to rotate in the sheet feeding direction, and the retard roller 51*b* is configured to rotate in the direction opposite to the sheet feeding direction. As illustrated in FIG. 3, two sets of the pickup roller 51*a* and the retard roller 51*b* are disposed in a state of being separated in the axial direction of a rotation shaft 51*c*, respectively.

Figure 7A:
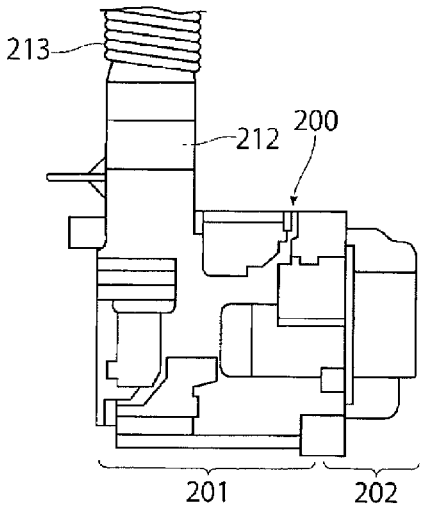
FIGS. 7A to 7C are configuration views illustrating a suction head member.
Figure 7B:
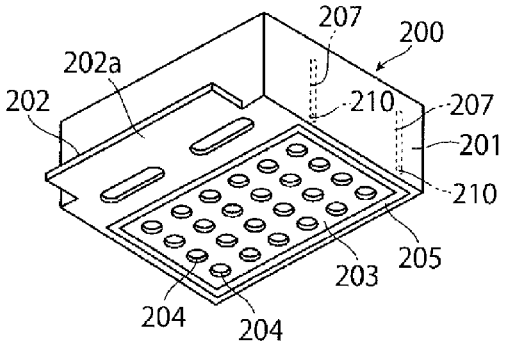
Figure 7C:
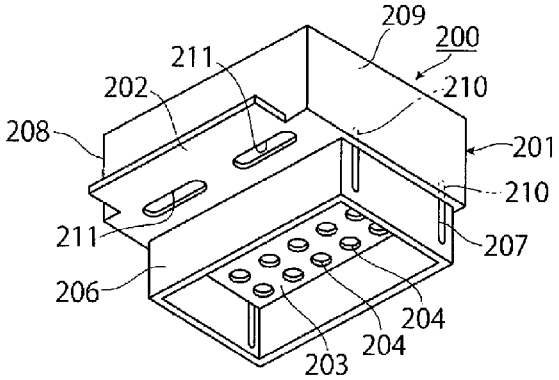

As illustrated in FIGS. 7A to 7C, the suction head member 200 includes a suctioning-up portion 201 that suctions a part of the uppermost recording sheet 5 stacked on the bottom plate 511 and moves the recording sheet 5 upward, and a holding portion 202 that suctions the leading end of the recording sheet 5 suctioned up by the suctioning-up portion 201 to abut against the reference surface so as to horizontally hold the posture of the leading end of the recording sheet 5.

More specifically, as illustrated in FIGS. 7B and 7C, the suctioning-up portion 201 of the suction head member 200 is formed by a synthetic resin or the like as a hollow box body having a substantially rectangular parallelepiped shape. A bottom wall 203 of the suctioning-up portion 201 of the suction head member 200 is provided with plural circular suction holes 204 in the vertical and horizontal directions. It is not necessary to provide the suction holes 204 having the same size in the vertical and horizontal directions, and a minimum number of suction holes 204 may be irregularly disposed so as to bilaterally symmetrical. Further, in the bottom wall 203 of the suctioning-up portion 201 of the suction head member 200, a gap 205 having a slit shape is formed in a rectangular shape along the outer peripheral edge of the suctioning-up portion 201 of the suction head member 200 so as to surround the outer periphery of the plural suction holes 204. The bottom wall 203 of the suctioning-up portion 201 of the suction head member 200 is attached to, for example, a ceiling wall by a fixing unit such as a long screw.

Inside the suctioning-up portion 201 of the suction head member 200, a skirt member 206 made of a thin synthetic resin film such as Mylar film (a product name) is accommodated so as to be advanceable from and retractable into the slit-shaped gap 205. The skirt member 206 is formed in a rectangular tube shape whose upper end surface and a lower end surface similar to the outer peripheral shape of the suction head member 200 are entirely opened. In the skirt member 206, linear sliding grooves 207 extending in the longitudinal direction of the skirt member 206 are formed in both end surfaces in the length direction of the skirt member 206. In each end surface, the sliding grooves 207 are arranged in the front-rear direction along the width direction. The sliding grooves 207 of the skirt member 206 are engaged with projecting portions 210 provided in the inner surface of both side walls 208 and 209 in the longitudinal direction of the suction head member 200. The skirt member 206 is configured to be movable inside the suction head member 200 along the vertical direction, and is normally stopped in a state of protruding downward from the bottom surface of the suction head member 200 by its own weight by a required length.

The holding portion 202 of the suction head member 200 is integrally provided in the downstream end portion of the suctioning-up portion 201 of the suction head member 200 in the sheet feeding direction. The holding portion 202 has a width the same as that of the suctioning-up portion 201 of the suction head member 200 or smaller than that of the suctioning-up portion 201, and is formed in a rectangular shape in a plan view that protrudes to the downstream in the sheet feeding direction. A lower end surface 202*a* of the holding portion 202 of the suction head member 200 is formed to be flat to form the same plane as the suctioning-up portion 201. The inside of the holding portion 202 is formed to be communicated with the suctioning-up portion 201. In the lower end surface 202*a* of the holding portion 202, two suction ports 211 that suction the leading end of the recording sheet 5 to be abutted with each other and horizontally maintain the posture of the leading end of the recording sheet 5 are opened along the width direction.

As illustrated in FIG. 7A, a suction duct 212 that suctions the inside of the suction head member 200 to a negative pressure is connected to one side surface of the suction head member 200. A suction fan 214 (see FIG. 3) is connected to the base end portion of the suction duct 212 via a bellows-shape member 213 allowing the movement of the suction head member 200. The suction fan 214 is an example of a suction unit.

Then, in the suction head member 200, the air inside is suctioned through the bellows-shape member 213 and the suction duct 212 by driving the suction fan 214 to be a negative pressure. In the suction head member 200, the air inside the skirt member 206 is suctioned through the plural suction holes 204 provided in the bottom surface thereof.

As described above, in the sheet feeding device 2, when feeding a sheet, the uppermost recording sheet 5 accommodated in the sheet feeding tray 50 is detected by the level sensor 517, and thus, the raising of the bottom plate 511 is stopped. At this time, as illustrated in FIG. 8A, the skirt member 206 is disposed at a position where the lower end portion of the skirt member 206 is in contact with the recording sheet 5 positioned uppermost in the sheet feeding tray 50, or is slightly moved upward.

Figure 8A:
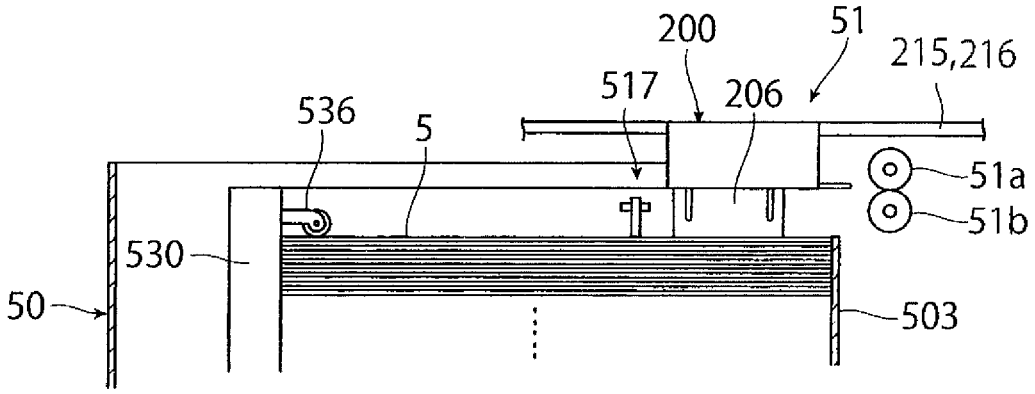
FIGS. 8A to 8C are configuration views illustrating a sheet feeding state of the sheet feeding device.

As a result, as illustrated in FIG. 8A, when the skirt member 206 is in contact with the recording sheet 5 positioned uppermost in the sheet feeding tray 50 at the lower end portion of the skirt member 206 and is closed, the inside of the skirt member 206 becomes a negative pressure. Then, in the suction head member 200, the lower end portion of the skirt member 206 suctions the uppermost recording sheet 5 in contact with each other and the inside of the skirt member 206 becomes a negative pressure, and thus, the skirt member 206 is moved upward in a state of suctioning the uppermost recording sheet 5. Finally, the suction head member 200 is in a state where the recording sheet 5 is directly suctioned up by the suction holes 204 in a state where the skirt member 206 is raised to be accommodated therein. The suction operation for the recording sheet 5 by the skirt member 206 acts on the uppermost recording sheet 5.

As illustrated in FIG. 8A, the position where the skirt member 206 of the suction head member 200 is disposed is set upstream in the sheet feeding direction by a required distance from the right wall 503 of the sheet feeding tray 50. As a result, the suction head member 200 is in a state where the leading end of the recording sheet 5 is suctioned by the two suction ports 211 in the holding portion 202 to be suctioned on the lower end surface 202*a* of the holding portion 202 in a state where the recording sheet 5 is directly suctioned.

Figure 8B:
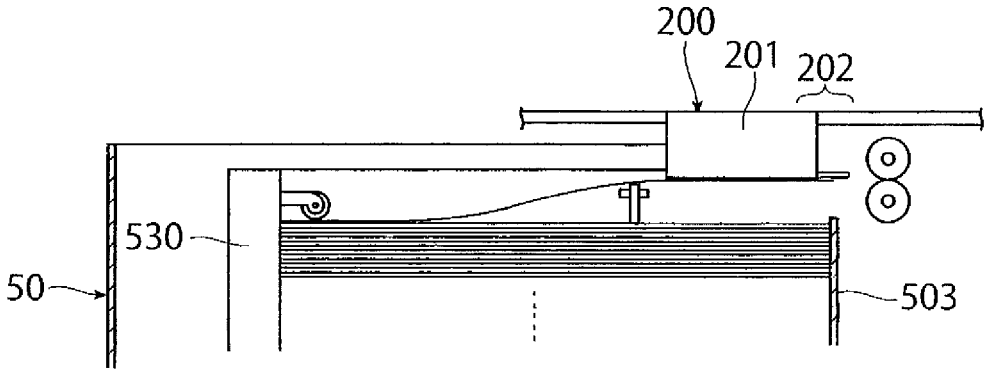

As illustrated in FIG. 8B, in the suction head member 200, when suctioning up the recording sheet 5, the leading end of the recording sheet 5 is adsorbed to the suction ports 211 in the holding portion 202 and is held in a planer state.

As illustrated in FIG. 3 and FIGS. 8A to 8C, the suction head member 200 is movable along the sheet feeding direction by two guide rails 215 and 216 disposed in parallel above the sheet feeding tray 50 along the sheet feeding direction. Further, the suction head member 200 is configured to be capable of reciprocating along the sheet feeding direction by a drive source including a driving motor (not illustrated) and the like.

In the suction head member 200, the inside of the skirt member 206 becomes a negative pressure when the skirt member 206 suctions the uppermost recording sheet 5, and the skirt member 206 is moved upward in a state of suctioning the uppermost recording sheet 5. As a result, the uppermost recording sheet 5 accommodated in the sheet feeding tray 50 is reliably separated from the second and subsequent recording sheets 5.

Figure 8C:
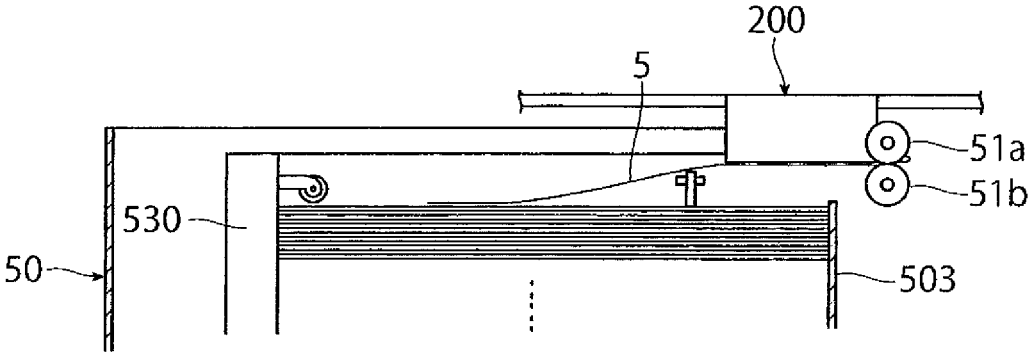

As illustrated in FIG. 8C, the suction head member 200 moves to downstream in the sheet feeding direction when suctioning and holding the recording sheet 5. Then, the leading ends of the recording sheets 5 are separated and fed one by one by the pickup roller 51*a* and the retard roller 51*b* disposed downstream of the sheet feeding tray 50 in the sheet feeding direction so as to be in contact with each other. After that, the suction head member 200 promptly returns to the position illustrated in FIG. 8A. In FIGS. 8B and 8C, for convenience, the original position of the level sensor 517 is illustrated.

As described above, the sheet feeding device 2 includes the level sensor 517 as a detector that detects the recording sheet 5 stacked on the bottom plate 511 by contacting the upper end surface thereof.

However, when feeding the recording sheet 5 from the sheet feeding tray 50, the sheet feeding device 2 according to the first exemplary embodiment adopts a vacuum feeding method in which the uppermost recording sheet 5 stacked on the bottom plate 511 is suctioned by the suction head member 200 to separate from other recording sheets 5 and is fed. As a result, as illustrated in FIGS. 8B and 8C, when feeding the sheet from the sheet feeding tray 50, the uppermost recording sheet 5 stacked on the bottom plate 511 is suctioned upward and passes through the position of the level sensor 517. As a result, after starting the sheet feeding operation from the sheet feeding tray 50, depending on the sheet feeding timing of the recording sheet 5, it may be difficult to detect the position of the uppermost recording sheet 5 stacked on the bottom plate 511 by the level sensor 517.

Therefore, in the first exemplary embodiment, it is configured such that the main end guide 530 is provided with a first sheet sensor 536 as a first detector that detects the recording sheet 5 stacked on the bottom plate 511 by contacting the upper end surface thereof.

As illustrated in FIG. 2, the first sheet sensor 536 includes a detecting member 537 that protrudes from the downstream surface of the main end guide 530 in the sheet feeding direction. The detecting member 537 is formed in a substantially L-shape in a side view including a horizontal portion 537*b* having a rotatable roller 537*a* in contact with the surface of the uppermost recording sheet 5 stacked on the bottom plate 511 at the tip end thereof, and a detecting portion 537*c* linearly disposed at the base end portion of the horizontal portion 537*b* along the vertical direction. The detecting member 537 is disposed at a position having a predetermined height of the main end guide 530 in a state allowing the upward movement. In the lower end portion of the detecting portion 537*c* of the detecting member 537, a detecting element 537*d* including an optical sensor and the like that is switched between ON and OFF by the movement of the detecting portion 537*c* in the vertical direction. In the first sheet sensor 536, when the surface of the uppermost recording sheet 5 stacked on the bottom plate 511 reaches a predetermined height, the roller 537*a* of the detecting member 537 is brought into contact with the surface, and the detecting member 537 is moved upward. Then, in the first sheet sensor 536, the detecting element 537*d* becomes an ON-state by the detecting portion 537*c* of the detecting member 537, and it is detected that the uppermost recording sheet 5 stacked on the bottom plate 511 reaches the predetermined height. The position of the uppermost recording sheet 5 detected by the first sheet sensor 536 is set to the same height as that of the level sensor 517.

As illustrated in FIGS. 3 and 4, in the first exemplary embodiment, the mini shutter member 546 detachably attached to the groove portion of the sheet stacking unit and closing the first notch portion 543 facing the first detector is detachably provided. The mini-shutter member 546 is an example of a closing unit. The first notch portion 543 is an example of a groove portion.

Figure 9A:
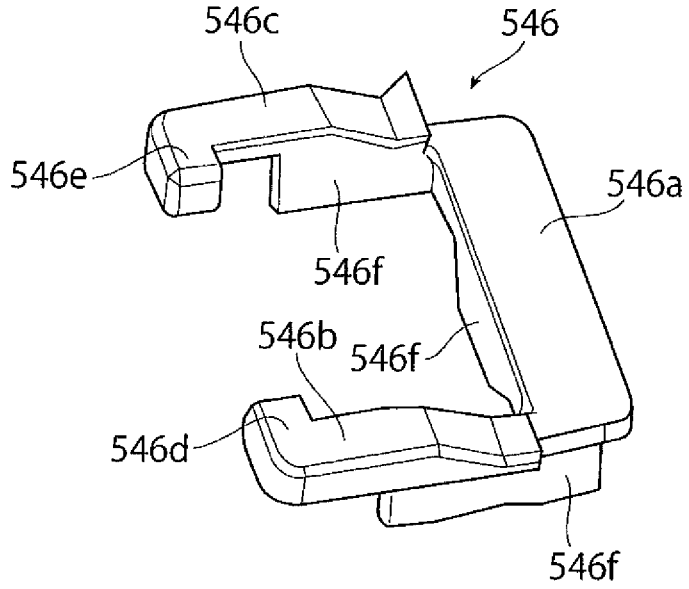
FIGS. 9A and 9B are perspective configuration views illustrating a mini shutter member.

As illustrated in FIG. 9A, the mini shutter member 546 is formed in a substantially rotated U-shape in a plan view larger than the outer peripheral shape of the main end guide 530 by integrally molding a synthetic resin or the like. The mini shutter member 546 includes a support plate portion 546*a* that is mounted in a state of being inserted into the first notch portion 543 and forms the same plane as the surface of the bottom plate 511 at a position facing the first sheet sensor 536, front and rear arm portions 546*b* and 546*c* in which both end portions of the support plate portion 546*a* are disposed over both front and rear surfaces of the main end guide 530, and side surface fixing portions 546*d* and 546*e* shortly disposed from the front and rear arm portions to the left side surface of the main end guide 530. Further, the mini shutter member 546 is provided with an inserting tube portion 546*f* provided on the lower end surfaces of the support plate portion 546*a*, and the front and rear arm portions 546*b* and 546*c* to protrude downward and inserted into the first notch portion 543.

Figure 9B:
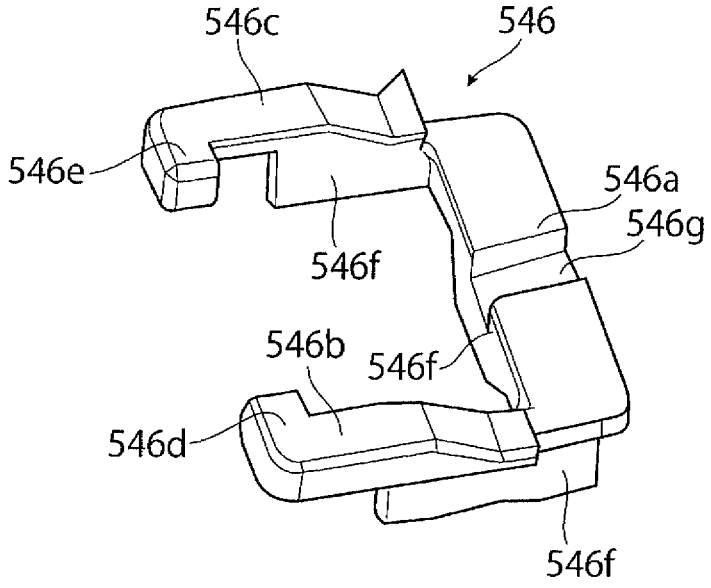

As illustrated in FIG. 3, the mini shutter member 546 is mounted on the outer periphery of the main end guide 530 in a state where the support plate portion 546*a* is inclined to be positioned on the lower side so as to avoid the first sheet sensor 536. The mini shutter member 546 moves together with the main end guide 530. As illustrated in FIG. 9B, the mini shutter member 546 may be configured to be provided with a recess portion 546*g* preventing interference with the roller 537*a* of the first sheet sensor 536 at a position corresponding to the first sheet sensor 536.

Further, in order to detach the mini shutter member 546, opposite to the mounting, the mini shutter member 546 is moved upward along the height direction of the main end guide 530, and is detached from the main end guide 530 in a state where the support plate portion 546*a* is inclined to be positioned on the lower side so as to avoid the first sheet sensor 536.

Before starting the sheet feeding operation, when the level sensor 517 detects the position of the uppermost recording sheet 5, the recording sheet 5 corresponding to the position of the first sheet sensor 536 enters the first notch portion 543 and is slightly lowered, and thus, when the first sheet sensor 536 detects that there is no sheet, the controller 100 detects (determines) that the user forget to mount the mini shutter member 546.

Further, as will be described later, when feeding a long recording sheet 5*a* by the sheet feeding tray 50, the mini shutter member 546 interferes with a raising tray member 601 provided on the bottom plate 511, and becomes an obstacle to provide the raising tray member 601 on the bottom plate 511, thereby preventing the user from forgetting to detach the mini shutter member 546.

However, in recent years, needs by users for the image forming apparatus 1 are diversified, and thus, the recording sheet 5 on which an image is formed by the image forming apparatus 1 is not limited to a standard sheet such as a normal A4 size sheet (210 mm×297 mm) or A3 size (297 mm×420 mm) sheet, and it is required to form an image on a so-called long recording sheet 5*a* (long sheet) or the like having a size larger (longer) than the A3 size in the sheet feeding direction. Along with this, the sheet feeding device 2 is capable of accommodating and feeding the long recording sheet 5*a* in addition to the standard sheet such as a normal A4 size sheet and A3 size sheet.

Figure 10A:
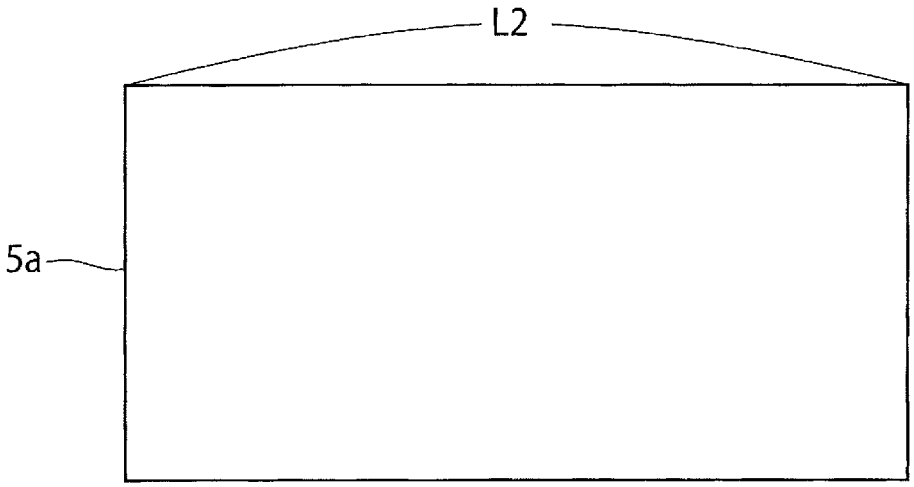
FIGS. 10A and 10B are plan views illustrating a recording sheet.
Figure 10B:
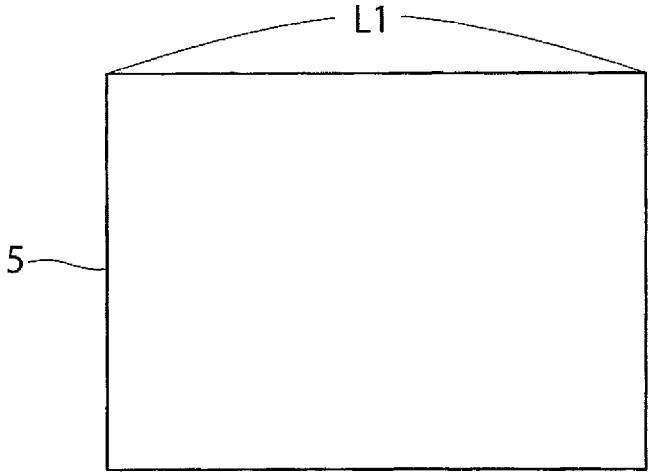

Here, as illustrated in FIGS. 10A and 10B, for example, the long recording sheet 5*a* means, among the recording sheets 5 having a standard size on which a normal image may be formed by the image forming apparatus 1, a recording sheet having a length L2 (=about 450 mm to 1,200 mm) in the transport direction larger than a length L1 (=420 mm) of the maximum size recording sheet 5 (for example, A3 size) in the transport direction. Examples of the long recording sheet 5*a* may include recording sheets having various sizes such as 210 mm×600 mm, 297 mm×900 mm, or 297 mm×1,200 mm. The sheet feeding device 2 according to the first exemplary embodiment is configured to be capable of feeding a sheet having a maximum length of 1,200 mm in the sheet feeding direction as a long recording sheet 5*a*. In the first exemplary embodiment, a recording sheet other than the long recording sheet 5*a* is denoted by a short recording sheet 5.

Further, examples of the material of the long recording sheet 5*a* may include a plain sheet, a thick sheet or the like as the same as a standard sheet such as a normal A4 size sheet or A3 size sheet, but the material is not particularly limited.

Figure 11:
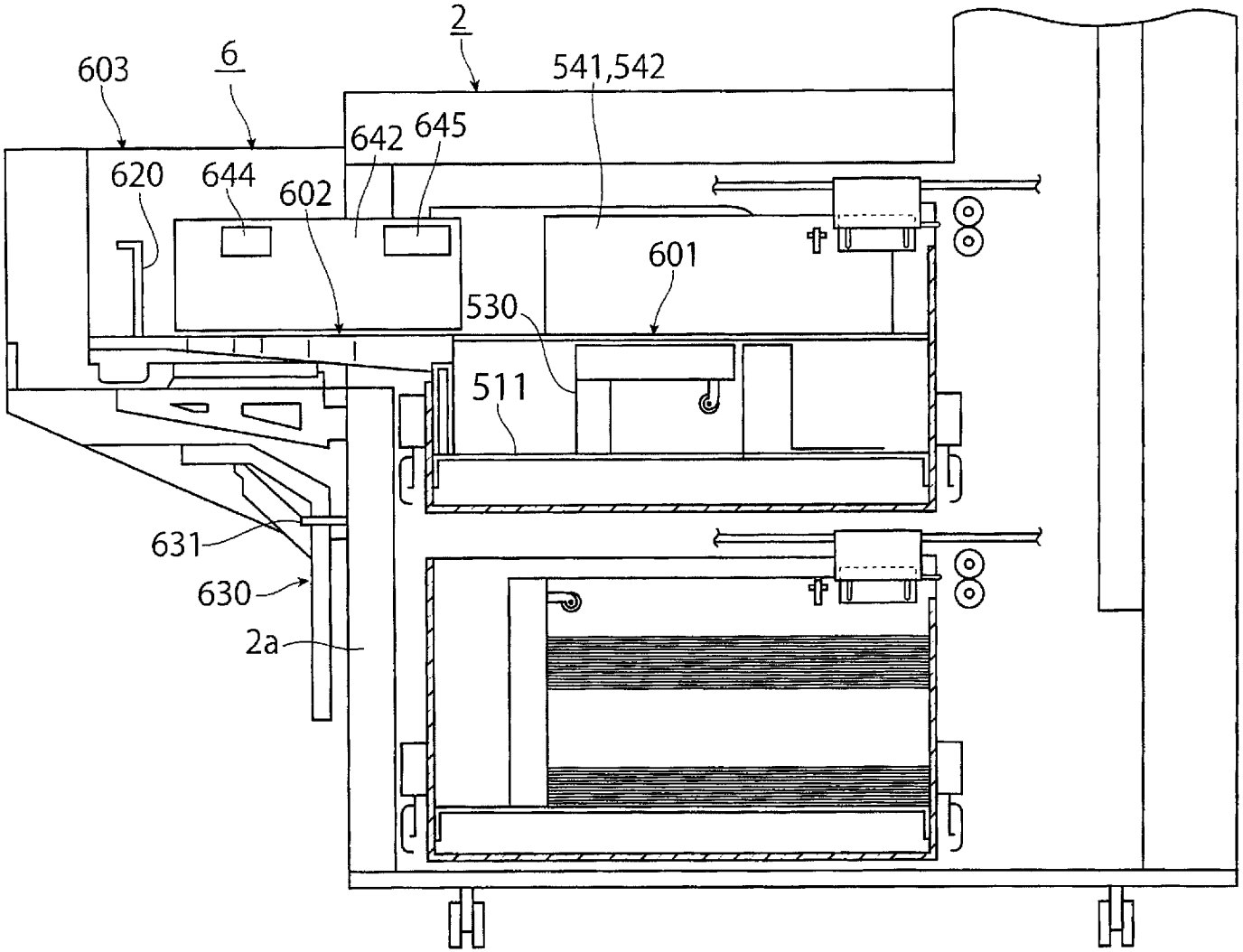
FIG. 11 is a configuration view illustrating the sheet feeding device as an example of the sheet feeding device according to the first exemplary embodiment of the present disclosure.

More specifically, as illustrated in FIG. 11, the sheet feeding device 2 according to the first exemplary embodiment includes a long sheet stacking device 6 detachably mounted on the bottom plate 511 of the sheet feeding tray 50. Long recording sheets 5*a* to be fed are stacked on the long sheet stacking device 6. The long sheet stacking device 6 is an example of a long sheet stacking unit.

The long sheet stacking device 6 is configured, for example, as an optional device used when feeding the long recording sheet 5*a* in the sheet feeding device 2, and is detachably attached to the bottom plate 511 of the sheet feeding device 2 and the body 2*a* of the sheet feeding device 2. The long sheet stacking device 6 is mounted in advance to the body 2*a* of the sheet feeding device 2 at the time of shipping of the sheet feeding device 2 according to the demand of users or the like, or is mounted to the body 2*a* of the sheet feeding device 2 after shipping (installing) of the sheet feeding device 2 according the demand of users or the like by a service engineer. As illustrated in FIG. 3, in the sheet feeding device 2, the pulling out of the sheet feeding tray 50 to which the long sheet stacking device 6 is mounted is prevented by a stopper mechanism S.

The long sheet stacking device 6 is configured to be, of course, capable of feeding the long recording sheet 5*a*, and also capable of feeding the short recording sheet 5 other than the long recording sheet as necessary. The sheet feeding device 2 may feed, for example, the recording sheet 5 having a length of 210 mm to a maximum of 1,200 mm in the sheet feeding direction by mounting the long sheet stacking device 6 as an optional device.

As illustrated in FIG. 11, the long sheet stacking device 6 is detachably attached to the left side surface of the body 2*a* of the sheet feeding device 2. When roughly classifying, the long sheet stacking device 6 mainly includes the raising tray member 601 provided on the bottom plate 511 of the sheet feeding tray 50 of the sheet feeding device 2, and a long sheet stacking tray 602 fixed to the raising tray member 601 in a state of protruding from the left side surface of the body 2*a* of the sheet feeding device 2, and an outer cover 603 covering the outer circumferential surface of the long sheet stacking tray 602.

In the sheet feeding device 2, when mounting the long sheet stacking device 6 as an optional device to the body 2*a* of the sheet feeding device 2, a part (an upper portion) of or the entire outer cover (not illustrated) provided on the left side surface of the body 2*a* is removed. As a result, in the sheet feeding device 2, among the two sheet feeding trays 50 vertically disposed in the body 2*a*, at least the left side surface of the sheet feeding tray 50 disposed in the upper portion is exposed to the outside. The long sheet stacking device 6 may be attached to the sheet feeding tray 50 disposed in the lower portion, among the two sheet feeding trays 50 disposed in the body 2*a* of the sheet feeding device 2.

Figure 12:
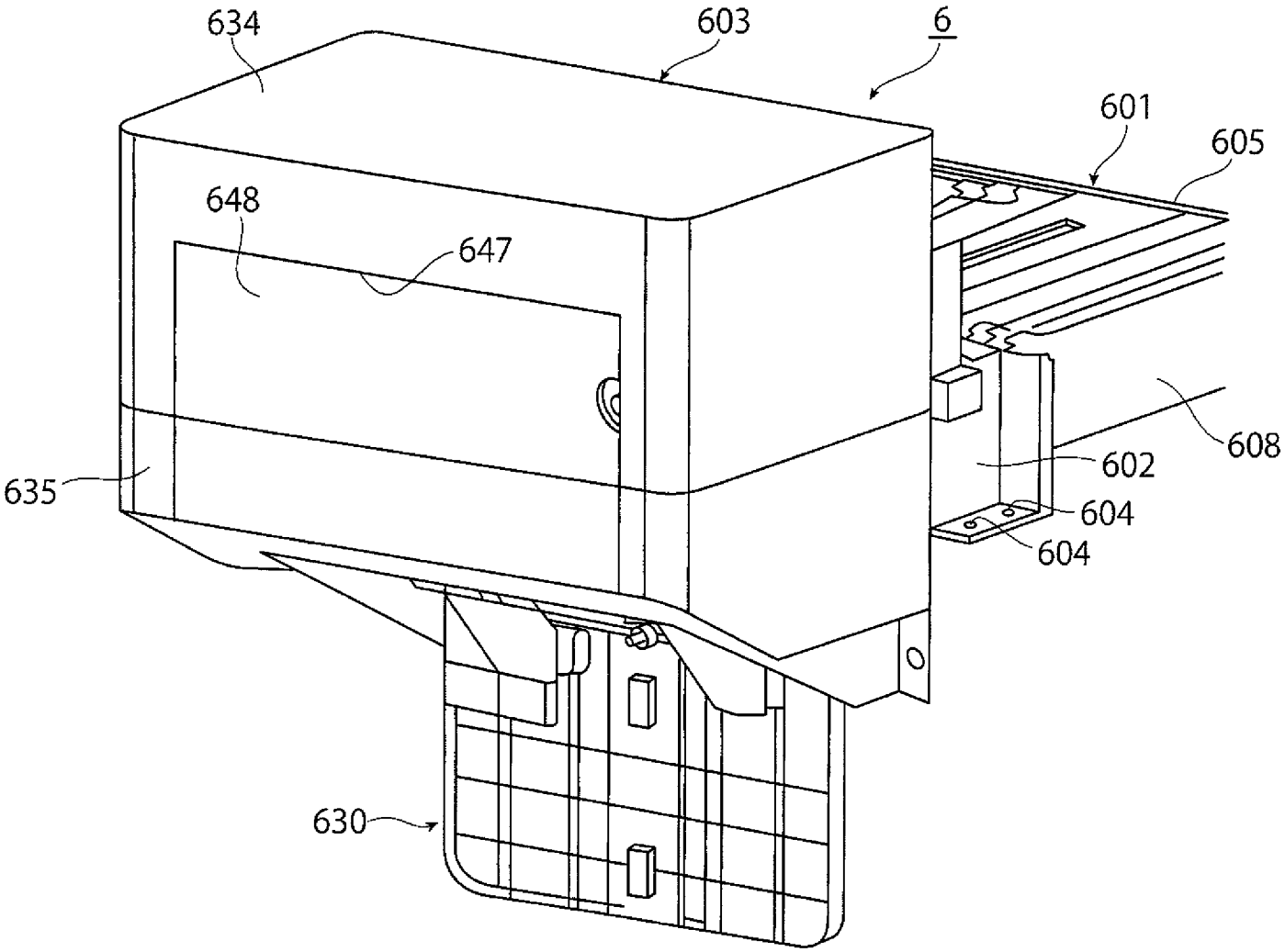
FIG. 12 is a perspective configuration view illustrating a main part of the sheet feeding device as an example of the sheet feeding device according to the first exemplary embodiment of the present disclosure.

As illustrate in FIGS. 6 and 12, the raising tray member 601 of the long sheet stacking device 6 is fixed by a method such as fixing screws 604 while being placed on the bottom plate 511 of the sheet feeding tray 50. The raising tray member 601 is a member that sets (raises) upward the surface of the bottom plate 511, which is the surface of the sheet feeding tray 50 on which the recording sheets 5 are stacked, to a required height, and thus, limits the number of long recording sheets 5*a* stacked on the bottom plate 511 of the sheet feeding tray 50. Further, the raising tray member 601 also has a function of avoiding interference between the long sheet stacking tray 602 of the long sheet stacking device 6 and the frame (not illustrated) of the sheet feeding tray 50 or the sheet feeding device 2. The raising tray member 601 moves along the vertical direction (moves up and down) together with the bottom plate 511.

The upper end surface of the raising tray member 601 has a predetermined height with respect to the bottom plate 511. As described above, the sheet feeding tray 50 is configured to be capable of stacking, for example, about 2,000 recording sheets 5. Meanwhile, the number of long recording sheets 5*a* that may be stacked in the sheet feeding tray 50 is limited to about 500 to 1,000 sheets by mounting the raising tray member 601 on the bottom plate 511.

As illustrated in FIG. 6, the raising tray member 601 is basically formed to have a planar shape similar to that of the bottom plate 511. The raising tray member 601 integrally includes a front end wall portion 605 having an elongated flat plate shape disposed over the substantially entire width along the right wall of the sheet feeding tray 50 at the downstream end portion of the bottom plate 511 in the sheet feeding direction, a rear end wall portion 606 disposed along the left wall 502 of the sheet feeding tray 50 at the upstream end portion of the bottom plate 511 in the sheet feeding direction, and front and rear connecting wall portions 608 and 609 disposed in the front-rear direction via a passage portion (groove portion) 607 positioned in the center in the width direction so as to connect the front end wall portion 605 and the rear end wall portion 606. The raising tray member 601 is formed such that the front end wall portion 605, the rear end wall portion 606, and the connecting wall portions 608 and 609 have a required height, and the upper end surface thereof is a flat surface. The passage portion 607 positioned between the front and rear connecting wall portions 608 and 609 of the raising tray member 601 allows the main end guide 530 of the sheet feeding tray 50, and, as illustrated in FIG. 6, is a groove portion accommodating the folded main end guide 530.

Figure 13:
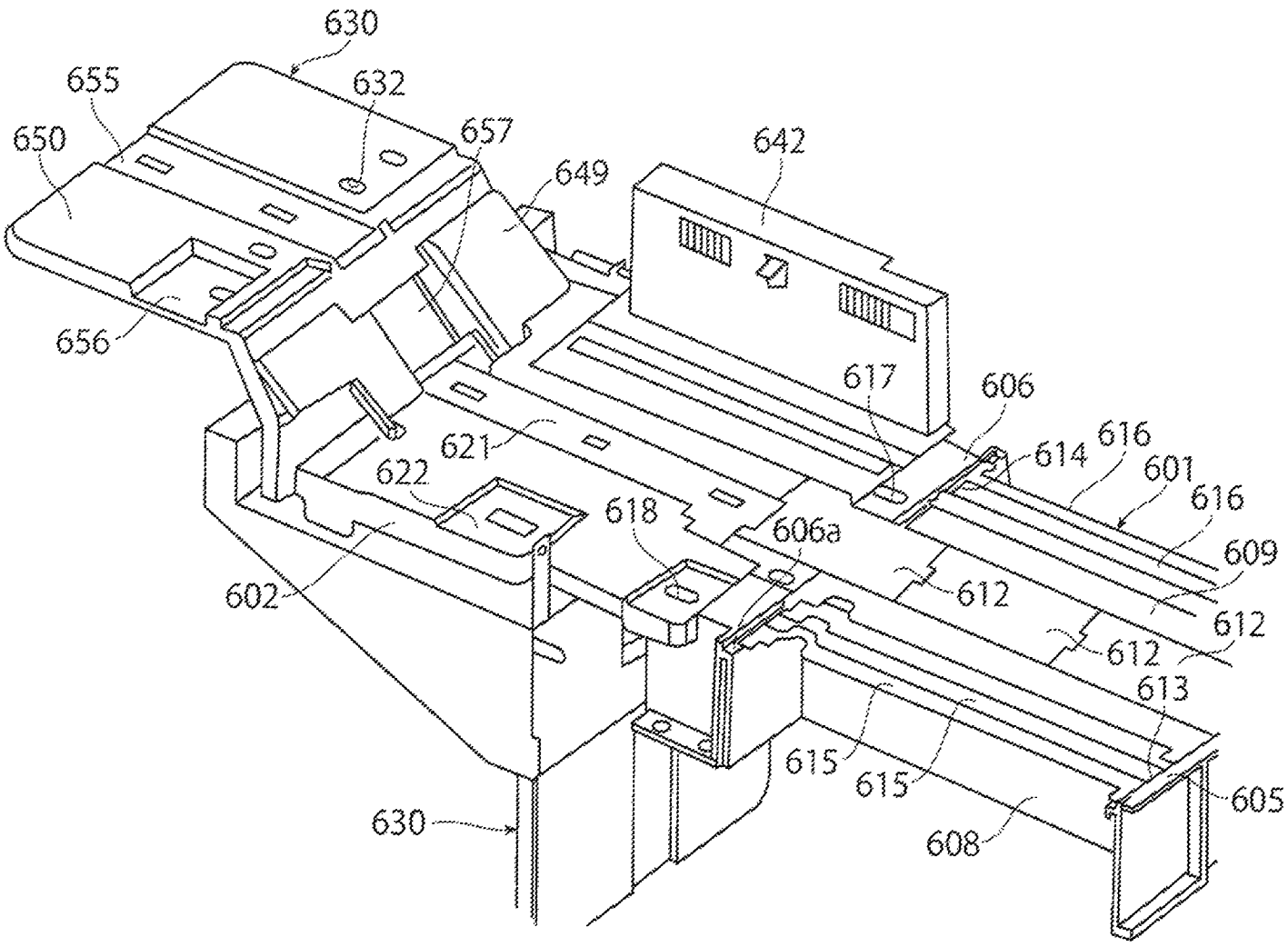
FIG. 13 is a perspective configuration view illustrating a main part of the sheet feeding device as an example of the sheet feeding device according to the first exemplary embodiment of the present disclosure.

As illustrated in FIG. 6, the front and rear connecting wall portions 608 and 609 are connected with each other by a connecting member 610 having a reversed U-shape in a cross-sectional view disposed in the intermediate portion in the sheet feeding direction and formed to be lower than the connecting wall portions 608 and 609. In the connecting portion 610, a lower end portion 611 on the side wall positioned downstream in the sheet feeding direction is bent parallel with the bottom plate 511 toward the downstream in the sheet feeding direction, and a fixing portion fixed to the bottom plate 511 by the screws 604 is configured. The width of the passage portion 607 is set to be the same as that of the first notch portion 543 in the bottom plate 511, or to be slightly larger than that of the first notch portion 543. As illustrated in FIG. 13, the passage portion 607 of the raising tray member 601 may be closed by plural shutter members 612 on the end side.

Further, as illustrated in FIGS. 6 and 13, both outer sides of the front and rear connecting wall portions 608 and 609 in the front-rear direction are provided with recess portions 613 and 614 having a rectangular shape in a plan view allowing the movement of the main side guides 541 and 542. The recess portions 613 and 614 are closed by plural shutter members 615 and 616 on the side configured to support the rear surface of the long recording sheet 5*a*.

The upper end surfaces of the front end wall portion 605, the rear end wall portion 606, and the connecting wall portions 608 and 609 of the raising tray member 601 are provided with stepped portions 605*a*, 606*a*, and 609*a* to which the plural shutter members 612 on the end side covering the passage portion 607, or the plural shutter members 615 and 616 on the side wall covering the recess portions 613 and 614 are mounted.

As illustrated in FIG. 13, in the rear end wall portion 606 of the raising tray member 601, the front end portion of the long sheet stacking tray 602 is provided in a state of being fixed by a method such as screwing through long holes 617 and 618. The long sheet stacking tray 602 moves along the vertical direction together with the bottom plate 511 of the sheet feeding tray 50 integrally with the raising tray member 601.

A sheet metal 621 that adsorbs and fixes an auxiliary end guide 620 by a magnetic force of a magnet is provided in the center portion of the long sheet stacking tray 602 in the width direction. As illustrated in FIG. 11, the auxiliary end guide 620 is formed in a substantially rotated U-shape in a side view, and a magnet is mounted on the rear surface of the bottom portion thereof. Further, as illustrated in FIG. 13, a sheet metal 622 that adsorbs and fixes an auxiliary side guide (not illustrated) by a magnetic force of a magnet is provided in the front end portion of the long sheet stacking tray 602 in the direction intersecting the sheet feeding direction. The auxiliary side guide is configured similarly to the auxiliary end guide 620. As will be described later, an auxiliary side guide 642 disposed in the end portion of the long sheet stacking tray 602 on the back side in the direction intersecting the sheet feeding direction is provided in the outer cover 603.

As illustrated in FIG. 11, the outer cover 603 of the long sheet stacking device 6 is mounted on the left side surface of the body 2*a* of the sheet feeding device 2.

Figure 14:
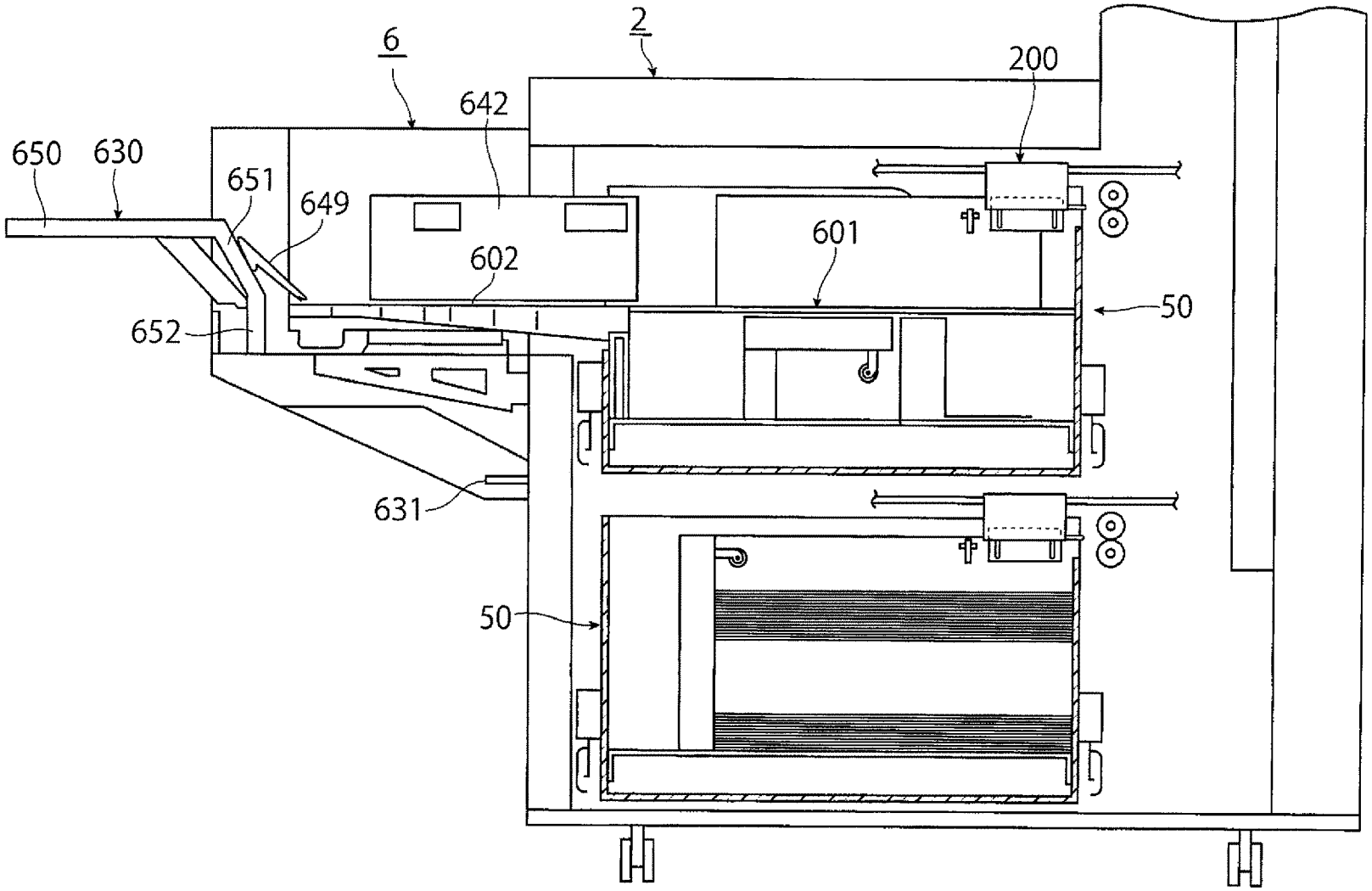
FIG. 14 is a configuration view illustrating a sheet feeding device as an example of the sheet feeding device according to the first exemplary embodiment of the present disclosure.

Basically, the long sheet stacking device 6 is configured to be capable of accommodating and feeding the long recording sheet 5*a* having a length up to 864 mm in the sheet feeding direction. As illustrated in FIGS. 13 and 14, in the long sheet stacking device 6, when accommodating and feeding the long recording sheet 5*a* having a length up to 1,200 mm, which is larger than 864 mm, in the sheet feeding direction, an auxiliary long tray 630 is separately provided in the outer cover 603. As illustrated in FIG. 11, when not in use, the auxiliary long tray 630 is hooked on a stud 631 provided in the end portion of the outer cover 603 on the body 2*a* side of the sheet feeding device 2 to protrude toward the outside through a long hole 632, and thus, is accommodated in the lower portion of the outer cover 603.

Figure 15A:
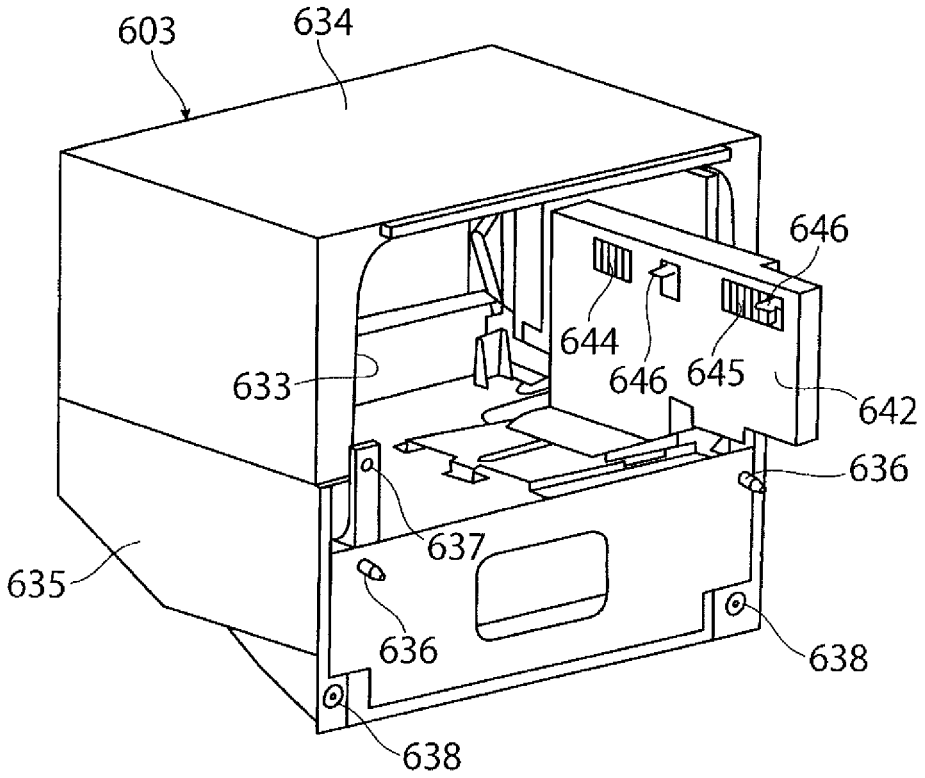
FIGS. 15A and 15B are perspective configuration views illustrating an outer cover.
Figure 15B:
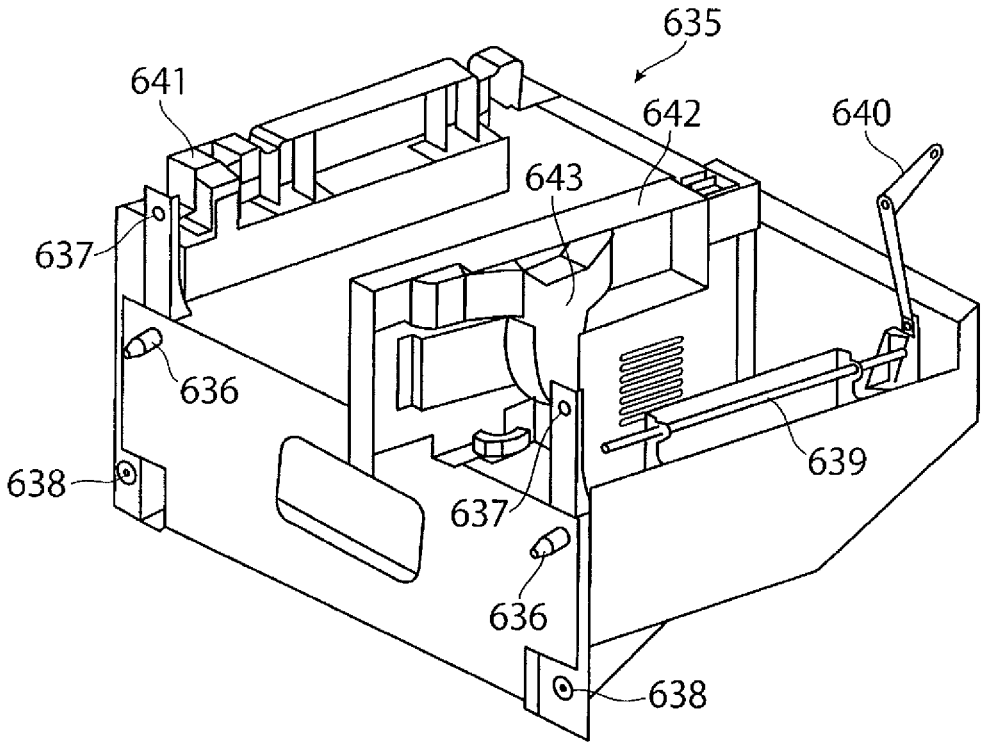

As illustrated in FIG. 11 and FIGS. 15A and 15B, the outer cover 603 is configured as a box body having a substantially rectangular parallelepiped shape. The outer cover 603 includes an opening 633 on the side surface on the body 2*a* side of the sheet feeding device 2 to communicate with the inside of the sheet feeding tray 50 of the sheet feeding device 2. The outer cover 603 is vertically divided, and includes an upper cover 634 and a lower cover 635. The lower cover 635 of the outer cover 603 is mounted to the body 2*a* of the sheet feeding device 2 via two studs 636 protruding to the body 2*a* side of the sheet feeding device 2, and fastening portions 637 and 638 respectively disposed above and below the studs 636.

As illustrated in FIG. 15B, the upper cover 634 of the outer cover 603 is mounted to be openable and closable about a support shaft 639 provided in the end portion on the back side of the lower cover 635. The reference numeral 640 indicates a regulation member that regulates the opening and closing angle of the upper cover 634.

As illustrated in FIG. 15B, the lower cover 635 of the outer cover 603 is provided with an interlock switch 641 that detects the opening/closing of the upper cover 634 and turns ON/OFF the power. Further, in the lower cover 635, the auxiliary side guide 642 is movable along the direction intersecting the sheet feeding direction. The auxiliary side guide 642 guides the back end portion of the long recording sheet 5*a* stacked in the long sheet stacking tray 602 in the direction intersecting the sheet feeding direction.

In the auxiliary side guide 642, a blowing fan (not illustrated) as a blowing unit that sends air to the upper end portion of the long recording sheets 5*a* stacked in the long sheet stacking tray 602 to separate is built in, in order to assist the separation of the long recording sheets 5*a* stacked on the upper end portion of the long sheet stacking tray 602. The blowing fan is configured to blow air to the long recording sheets 5*a* stacked in the long sheet stacking tray 602 from two blowing ports 644 and 645 arranged in the vicinity of the upper end portion of the auxiliary side guide 642 along the sheet feeding direction through a blowing duct 643. The two blowing ports 644 and 645 are provided with louvers directing the air flow toward the downstream in the sheet feeding direction, respectively. Further, the auxiliary side guide 642 is provided with a regulating plate 646 regulating the upward movement of the long recording sheets 5*a* stacked in the long sheet stacking tray 602.

As illustrated in FIG. 11, in the outer cover 603, the auxiliary long tray 630 used when accommodating and feeding the long recording sheet 5*a* having a length up to 1,200 mm, which is larger than 864 mm, in the sheet feeding direction, is separately provided in the outer cover 603. As illustrated in FIG. 12, the lower cover 635 of the outer cover 603 is provided with an auxiliary opening 647 in the left side surface thereof. The auxiliary opening 647 is normally closed by a lid 648. The lid 648 is detachably attached to the upper cover 634.

In the outer cover 603, the auxiliary long tray 630 is mounted to the lower cover 635 by a thumb screw (not illustrated) that is a bolt having a synthetic resin knob by removing the lid 648 and opening the auxiliary opening 647. Further, an inclined tray 649 is rotatably provided at the rear end portion of the auxiliary long tray 630 in the space to the long sheet stacking tray 602.

The auxiliary long tray 630 includes a horizontal plate portion 650 having the same height as that of the bottom plate 511 moved to the uppermost end portion, a short inclined plate portion 651 inclined toward the long sheet stacking tray 602 at the front end portion of the horizontal plate portion 650 in the sheet feeding direction, and a vertical plate portion 652 disposed along the vertical direction from the lower end portion of the inclined plate portion 651. When the bottom plate 511 is raised most, the horizontal plate portion 650 of the auxiliary long tray 630 forms a plane having the same height as the long sheet stacking tray 602 and the raising tray member 601 via the inclined tray 649. The detaching operation of the auxiliary long tray 630 is performed by a user.

As illustrated in FIG. 13, a sheet metal 655 that adsorbs and fixes the auxiliary end guide 620 by a magnetic force of a magnet is provided in the center portion of the horizontal plate portion 650 of the auxiliary long tray 630 in the width direction. Further, a sheet metal 656 that adsorbs and fixes an auxiliary side guide (not illustrated) by a magnetic force of a magnet is provided in the front end portion of the auxiliary long tray 630 in the direction intersecting the sheet feeding direction. The auxiliary side guide is configured similarly to the auxiliary end guide 620. Further, a sheet metal 657 that adsorbs and fixes an auxiliary end guide 620 by a magnetic force of a magnet is provided in the center portion of the inclined tray 649 in the width direction.

Figure 16:
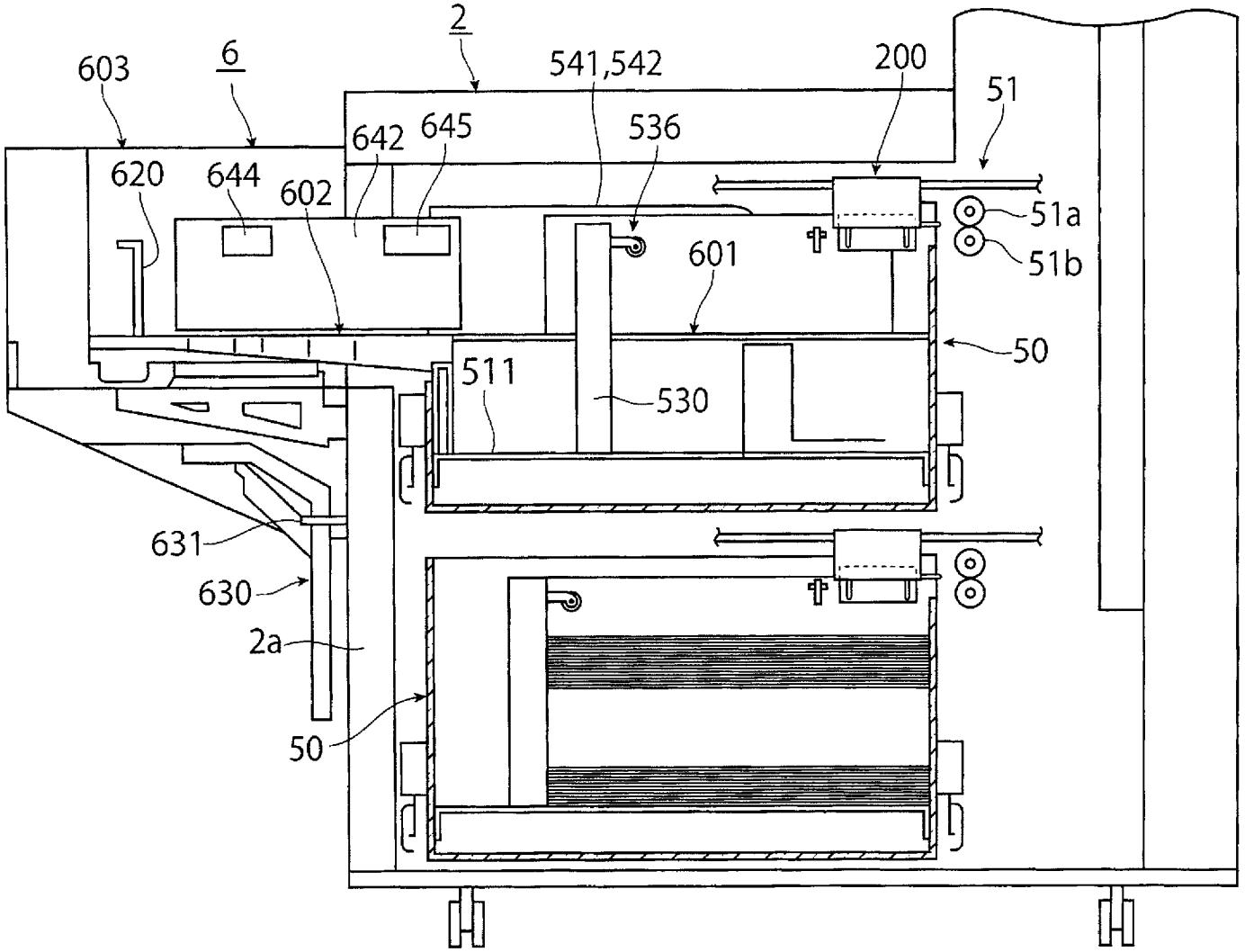
FIG. 16 is a configuration view illustrating the sheet feeding device as an example of the sheet feeding device according to the first exemplary embodiment of the present disclosure.

As illustrated in FIG. 16, in the long sheet stacking device 6, when feeding the short recording sheet 5 instead of the long recording sheet 5*a*, the upper end portion 531 of the main end guide 530 is deformed into an upright state. At this time, in the raising tray member 601, the passage portion 607 is opened by moving the plural shutter members 612 on the end side. Then, the main end guide 530 is moved to a position where it comes into contact with the upstream end portion of the recording sheets 5 stacked on the raising tray member 601 in the sheet feeding direction. After that, in the passage portion 607 of the raising tray member 601, the areas other than the main end guide 530 are closed by the shutter member 612 on the end side. At this time, the mini shutter member 546 is not used.

Further, the sheet feeding device 2 according to the first exemplary embodiment further includes one of the main side guides (that is, the main side guide 541) guiding the end portion of the sheet stacked on the sheet stacking unit in the direction intersecting the feeding direction, and a second detector that is advanceable from and retractable into the main side guides 541, and detecting the sheets stacked in the sheet stacking unit by contacting the upper ends thereof. The main side guide 541 is an example of the second guide.

As illustrated in FIG. 11, in the sheet feeding device 2 according to the first exemplary embodiment, the long sheet stacking device 6 is mounted when feeding the long recording sheets 5*a*. At this time, in the sheet feeding tray 50, since the main end guide 530 is folded, the first sheet sensor 536 provided in the main end guide 530 is not able to detect the upper end portion of the long recording sheet 5*a*.

Figure 17:
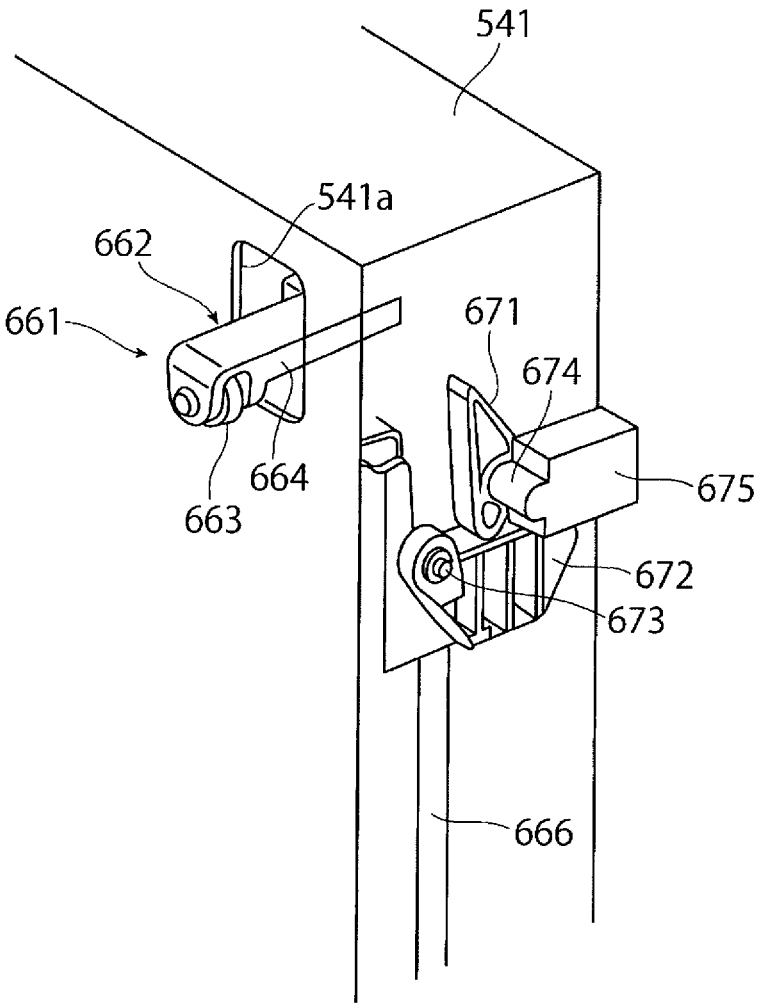
FIG. 17 is a perspective configuration view illustrating a main part of a main side guide.

As a result, as illustrated in FIG. 17, among the two side guides 541 and 542, the main side guide 541 positioned on the front side in the direction intersecting the sheet feeding direction is provided with a second sheet sensor 661. The second sheet sensor 661 is mounted in the vicinity of the upstream end portion of the main side guide 541 in the sheet feeding direction.

Figure 18A:
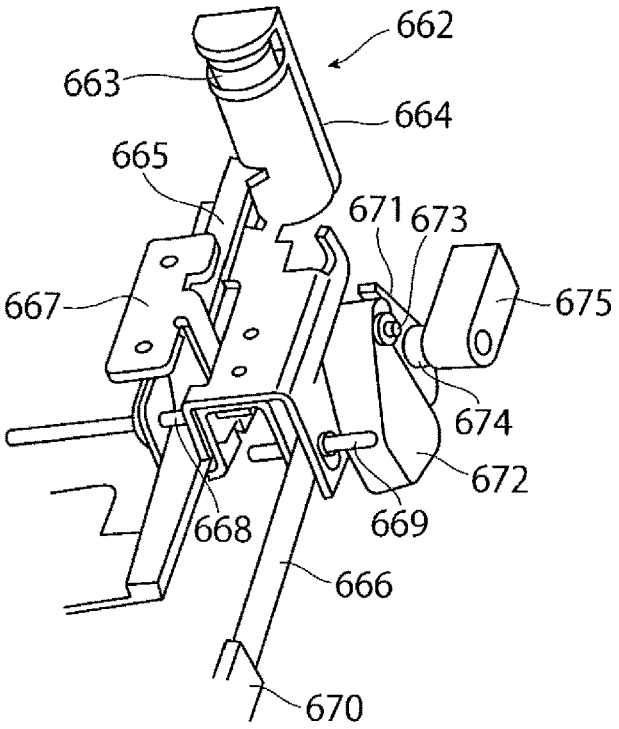
FIGS. 18A and 18B are perspective configuration views illustrating a second sheet sensor.

The second sheet sensor 661 includes a detecting member 662 that is advanceable from and retractable into the opening 541*a* of the main side guide 541 on the upstream side surface in the sheet feeding direction. As illustrated in FIG. 18A, the detecting member 662 is formed in a substantially L-shape in a side view including a horizontal portion 664 having a rotatable roller 663 in contact with the surface of the uppermost recording sheet 5 stacked on the bottom plate 511 at the front end thereof, and a shaft support portion 665 linearly disposed at the base end portion of the horizontal portion 664 along the vertical direction, and a detecting portion 666 disposed on one side of the shaft support portion 665 in the axial direction.

The shaft support portion 665 of the detecting member 662 is supported to be rotatable about a rotation shaft 668 with respect to a bearing member 667 provided on the inner surface of the main side guide 541. Further, the detecting portion 666 is rotatable about a spindle 669 on a side of the shaft support portion 665 of the detecting member 662. The detecting portion 666 is formed in a rod shape, and is provided with a rectangular shape detecting plate 670 at the lower end portion thereof. The detecting plate 670 is provided with a detecting element (not illustrated) including an optical sensor or the like sensing the movement of the detecting plate 670.

An eccentric cam 671 and a cam follower 672 that cause the detecting member 662 to project and retract from the side surface of the main side guide 541 are provided on the side of the second sheet sensor 661. The cam follower 672 is rotatable about a support shaft 673 inside the main side guide 541. Further, the eccentric cam 671 is rotatable about a support shaft 674 on the side surface of the main side guide 541. An operation lever 675 provided on the outer surface of the main side guide 541 is provided on the support shaft 674 in a fixed state. The operation lever 675 is exposed alone to the outside of the main side guide 541, and all other members are disposed inside the main side guide 541.

Figure 18B:
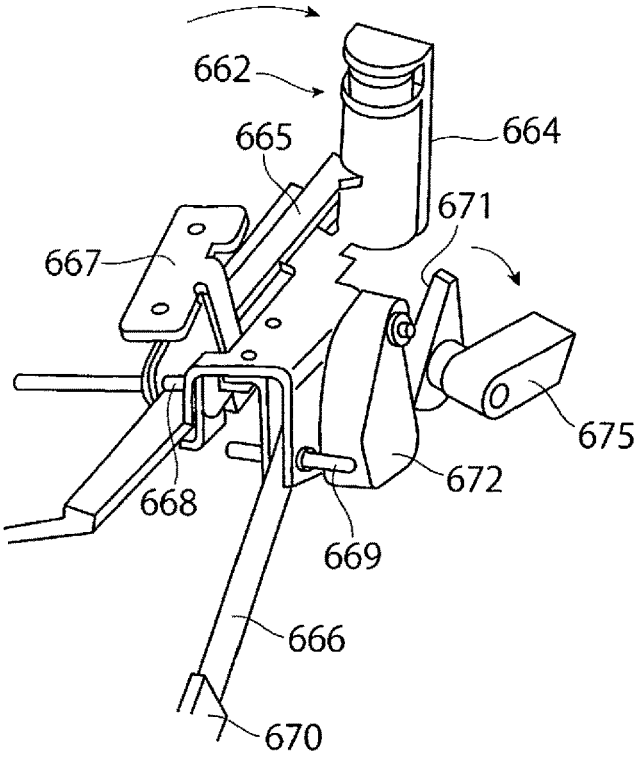

As illustrated in FIG. 18B, in the second sheet sensor 661, when a user manually performs an operation to rotate the operation lever 675 in the clockwise direction, the projecting portion of the eccentric cam 671 pushes down the cam follower 672 and the cam follower 672 is rotated in the clockwise direction. Then, the cam follower 672 pushes down the spindle 669 and the detecting member 662 is rotated in the clockwise direction about the rotation shaft 668, and then, the detecting member 662 is retracted to the inside of the main side guide 541.

In the second sheet sensor 661, when the bottom plate 511 is raised, the roller 663 of the detecting member 662 comes into contact with the upper end portion of the long recording sheet 5*a* stacked on the raising tray member 601 provided on the bottom plate 511. Then, the detecting member 662 is rotated about the rotation shaft 668 in the clockwise direction in FIG. 18A. Then, the detecting portion 666 provided on the spindle 669 of the detecting member 662 moves upward and the detecting element (not illustrated) becomes an ON-state by the detecting plate 670 of the detecting portion 666, and detects that the uppermost recording sheet 5 stacked on the bottom plate 511 reaches a predetermined height. The position of the uppermost recording sheet 5 detected by the second sheet sensor 661 is set to the same height as that of the first sheet sensor 536 and the level sensor 517.

Meanwhile, in the sheet feeding device 2 according to the first exemplary embodiment, since the second sheet sensor 661 is not required when feeding the short recording sheets 5, the second sheet sensor 661 is accommodated inside the main side guide 541 by rotating the operation lever 675.

(Operation of Sheet Feeding Device)

In the sheet feeding device 2 according to the first exemplary embodiment, it is possible to switch between the feeding of the long sheets and the feeding of the short sheets with a simple configuration, as compared with the case where the long-sheet option is detachably provided in the sheet stacking unit when feeding the long sheet, as follows.

That is, as illustrated in FIG. 2, in the sheet feeding device 2 according to the first exemplary embodiment, when feeding the standard recording sheets 5 such as A4 size sheets or A3 size sheets, the recording sheets 5 are stacked at a required position on the bottom plate 511. The recording sheets 5 are stacked on the bottom plate 511 in a state where the front end portion thereof abuts against the right wall 503 of the sheet feeding tray 50. Further, the recording sheets 5 are stacked such that the center in the direction intersecting the sheet feeding direction coincides with the center of the bottom plate 511.

In this state, the recording sheets 5 stacked on the bottom plate 511 abut against the main end guide 530 at the rear end portion thereof in the sheet feeding direction, and are stacked on the bottom plate 511 to be abutted against the left and right main side guides 541 and 542 at both end portions thereof in the direction intersecting the sheet feeding direction.

Subsequently, the sheet feeding tray 50 is pushed into the body 2*a* of the sheet feeding device 2, and thus, the sheet feeding tray 50 is mounted to the required position in the body 2*a* of the sheet feeding device 2.

As illustrated in FIG. 5, in the sheet feeding device 2, when detecting that the sheet feeding tray 50 is mounted to the body 2*a* of the sheet feeding device 2 by an open/close sensor (not illustrated), the bottom plate 511 starts to move upward by the driving motor 515. When the bottom plate 511 moves upward, the uppermost recording sheet 5 among the recording sheets 5 stacked on the bottom plate 511 comes into contact with the level sensor 517, and it is detected that the uppermost recording sheet 5 stacked on the bottom plate 511 is raised to the required height, and then the driving motor 515 is stopped.

At this time, as illustrated in FIGS. 8A to 8C, the uppermost recording sheet 5 is in contact with the skirt member 206 of the suction head member 200. Then, the uppermost recording sheet 5 is suctioned by the skirt member 206 of the suction head member 200 and is sequentially fed.

As illustrated in FIG. 11, when feeding the long recording sheet 5*a* in the sheet feeding device 2, the long sheet stacking device 6 is mounted on the left side surface of the body 2*a* of the sheet feeding device 2. Basically, the long sheet stacking device 6 is shipped to a user in a state of being mounted to the body 2*a* of the sheet feeding device 2. However, the long sheet stacking device 6 may be mounted to the body 2*a* of the sheet feeding device 2 by a service engineer after being shipped.

Basically, the long sheet stacking device 6 accommodates the long recording sheet 5*a* having a length up to 864 mm in the sheet feeding direction and feeds to the image forming apparatus 1.

In the sheet feeding device 2, when mounting the long sheet stacking device 6, the main end guide 530 is folded. At this time, as illustrated in FIG. 4, the mini shutter member 546 mounted to the main end guide 530 is detached from the first notch portion 543 of the bottom plate 511.

In this state, as illustrated in FIG. 11, the raising tray member 601 is mounted to the bottom plate 511 of the sheet feeding device 2, and the long sheet stacking tray 602 is provided in the raising tray member 601. The long recording sheets 5*a* are stacked on the raising tray member 601 and the long sheet stacking tray 602. The auxiliary end guide 620 is disposed at the rear end portion of the long recording sheets 5*a* in the sheet feeding direction, and the main side guides 541 and 542 and the auxiliary side guide 642 are disposed at the both end portions of the long recording sheets 5*a* in the direction intersecting the sheet feeding direction. Further, as illustrated in FIG. 18A, the second sheet sensor 661 provided in the main side guide 541 is moved to the detectable projecting position by operating the operation lever 675.

After that, in the sheet feeding device 2, similarly to the short recording sheet 5, the bottom plate 511 of the sheet feeding device 2 moves upward, and the raising of the bottom plate 511 is stopped in a state where the uppermost long recording sheet 5*a* is detected by the level sensor 517.

Subsequently, in the sheet feeding device 2, similarly to the short recording sheet 5, the suction head member 200 of the sheet feeding device 2 is driven, and the uppermost long recording sheet 5*a* is sequentially fed. The position of the uppermost long recording sheet 5*a* after the start of the sheet feeding is detected by the second sheet sensor 661.

As illustrated in FIG. 14, when feeding the long recording sheet 5*a* having a length of larger than 864 mm and up to 1,200 mm in the sheet feeding direction in the sheet feeding device 2, the auxiliary long tray 630 is mounted to the long sheet stacking device 6 by a user.

Meanwhile, as illustrated in FIG. 16, when feeding the short recording sheet 5 in the sheet feeding device 2, with the operation by a user, the main end guide 530 is deformed into an upright state in the raising tray member 601, and the rear end portion of the short recording sheets 5 stacked on the raising tray member 601 in the sheet feeding direction is supported and guided. The position of the uppermost short recording sheet 5 stacked on the raising tray member 601 is detected by the first sheet sensor 536 provided in the main end guide 530.

As described above, in the sheet feeding device 2 according to the first exemplary embodiment, it is possible to switch between the feeding of the long recording sheets 5*a* and the feeding of the short recording sheets 5 with a simple configuration, as compared with the case where the long-sheet option is detachably provided in the sheet stacking unit when feeding the long sheet.

Second Exemplary Embodiment

Figure 19:
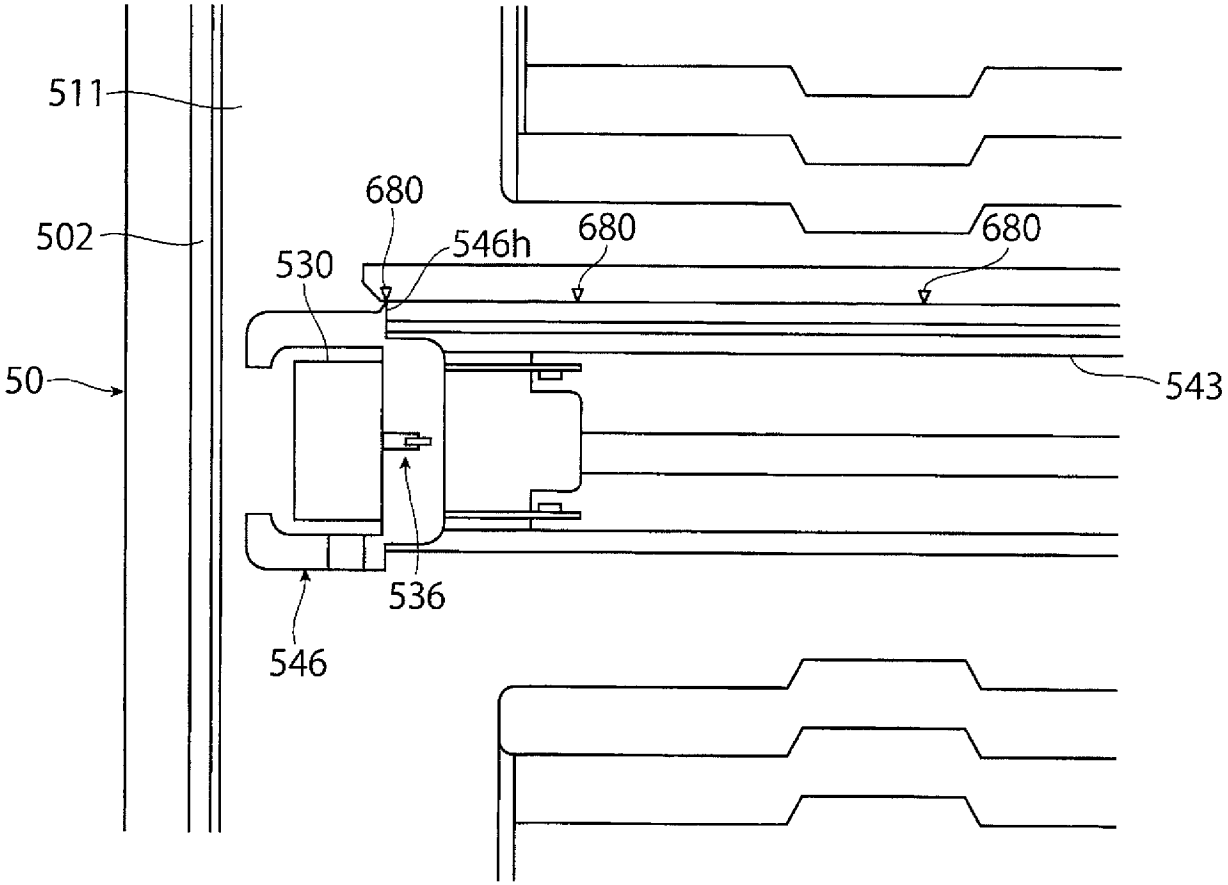
FIG. 19 is a planar configuration view illustrating a main part of the sheet feeding device as an example of the sheet feeding device according to a second exemplary embodiment of the present disclosure.

FIG. 19 is a configuration view illustrating a sheet feeding device according to a second exemplary embodiment of the present disclosure.

The sheet feeding device 2 according to the second exemplary embodiment is configured such that the closing unit includes an indicator that indicates the size of the sheet in accordance with the position of the first guide.

More specifically, in the sheet feeding device 2 according to the second exemplary embodiment, as illustrated in FIG. 19, in the mini shutter member 546, an indicating portion 546*h* protrudes toward the side, at a position that is an end portion of the rear arm portion 546*c* on the support plate portion 546*a* and corresponding to the downstream end surface 530*a* of the main end guide 530. The mini shutter member 546 is an example of the closing unit. The indicating portion 546*h* is an example of an indicator.

Further, in the bottom plate 511, plural scales 680 indicating the size of the short recording sheet 5 stacked on the bottom plate 511 are provided on the back side of the first notch portion 543 in the longitudinal direction of the first notch portion 543.

As described above, as illustrated in FIG. 19, in the sheet feeding device 2 according to the second exemplary embodiment, the indicating portion 546*h* of the mini shutter member 546 mounted to the main end guide 530 is aligned with any one of the plural scales 680 of the bottom plate 511, and thus, it is possible to easily discriminate the size of the short recording sheet 5 stacked on the bottom plate 511.

Since other configurations and operations are the same as those in the first exemplary embodiment, the description thereof is omitted.

In the above exemplary embodiments, the case where the sheet feeding device is applied to a color printer adopting an electrophotographic system as an image forming apparatus has been described. However, the present disclosure is not limited thereto, and, of course, the image forming apparatus may adopt an inkjet method, a printing method, or the like to form a full color or monochrome image.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A sheet feeding device comprising:

a sheet stacking unit that is movable up and down, the sheet stacking unit being configured such that sheets to be fed are stacked on the sheet stacking unit;

a long sheet stacking unit detachably mounted on the sheet stacking unit, the long sheet stacking unit being configured such that long sheets to be fed are stacked on the long sheet stacking unit;

a first guide that is movable along a feeding direction of the sheets through a groove provided in the sheet stacking unit, the first guide being deformable into a shape that does not interfere with the long sheet stacking unit, the first guide being configured to guide a rear end portion of the sheets in the feeding direction of the sheets stacked on the sheet stacking unit;

a first detector provided in the first guide, the first detector being configured to detect the sheets stacked on the sheet stacking unit by contacting an upper end of the sheets; and a closing unit detachably attached to the groove in the sheet stacking unit, the closing unit being configured to close the groove facing the first detector.

2. The sheet feeding device according to claim 1, wherein the closing unit is detachably attached to the first guide.

3. The sheet feeding device according to claim 2, wherein the closing unit has a recess at a position corresponding to the first detector.

4. An image forming apparatus comprising:

a sheet feeding unit configured to feed a sheet; and an image forming unit configured to form an image on the sheet fed from the sheet feeding unit, wherein the sheet feeding device according to claim 2 is used as the sheet feeding unit.

5. An image forming apparatus comprising:

a sheet feeding unit configured to feed a sheet; and an image forming unit configured to form an image on the sheet fed from the sheet feeding unit, wherein the sheet feeding device according to claim 3 is used as the sheet feeding unit.

6. The sheet feeding device according to claim 1, wherein the closing unit comprises an indicator indicating a size of the sheets in accordance with a position of the first guide.

7. An image forming apparatus comprising:

a sheet feeding unit configured to feed a sheet; and an image forming unit configured to form an image on the sheet fed from the sheet feeding unit, wherein the sheet feeding device according to claim 6 is used as the sheet feeding unit.

8. The sheet feeding device according to claim 1, wherein the first guide is folded when the long sheets are stacked on the long sheet stacking unit.

9. The sheet feeding device according to claim 8, wherein the closing unit is removed when the first guide is folded.

10. An image forming apparatus comprising:

a sheet feeding unit configured to feed a sheet; and an image forming unit configured to form an image on the sheet fed from the sheet feeding unit, wherein the sheet feeding device according to claim 9 is used as the sheet feeding unit.

11. An image forming apparatus comprising:

a sheet feeding unit configured to feed a sheet; and an image forming unit configured to form an image on the sheet fed from the sheet feeding unit, wherein the sheet feeding device according to claim 8 is used as the sheet feeding unit.

12. The sheet feeding device according to claim 1, wherein upon detection of absence of the sheets in a state where the sheet stacking unit is moved up to a position where the sheets can be fed, the first detector detects that a user forgets to mount the closing unit.

13. An image forming apparatus comprising:

a sheet feeding unit configured to feed a sheet; and an image forming unit configured to form an image on the sheet fed from the sheet feeding unit, wherein the sheet feeding device according to claim 12 is used as the sheet feeding unit.

14. The sheet feeding device according to claim 1, further comprising:

a second guide configured to guide an end portion of the sheets stacked on the sheet stacking unit in a direction intersecting the feeding direction; and a second detector that is advanceable from and retractable into the second guide, the second detector being configured to detect the sheets stacked on the sheet stacking unit by contacting the upper end of the sheets.

15. The sheet feeding device according to claim 14, wherein the second detector is operated to protrude to a position where the second detector can detect the sheets when the first guide is deformed into the shape that does not interfere with the long sheet stacking unit.

16. An image forming apparatus comprising:

a sheet feeding unit configured to feed a sheet; and an image forming unit configured to form an image on the sheet fed from the sheet feeding unit, wherein the sheet feeding device according to claim 15 is used as the sheet feeding unit.

17. An image forming apparatus comprising:

a sheet feeding unit configured to feed a sheet; and an image forming unit configured to form an image on the sheet fed from the sheet feeding unit, wherein the sheet feeding device according to claim 14 is used as the sheet feeding unit.

18. An image forming apparatus comprising:

a sheet feeding unit configured to feed a sheet; and an image forming unit configured to form an image on the sheet fed from the sheet feeding unit, wherein the sheet feeding device according to claim 1 is used as the sheet feeding unit.

* * * * *